US007282864B2

(12) United States Patent
Takeuchi

(10) Patent No.: US 7,282,864 B2
(45) Date of Patent: Oct. 16, 2007

(54) DISCHARGE LAMP AND CONTROL OF THE SAME

(75) Inventor: Kesatoshi Takeuchi, Shioziri (JP)

(73) Assignee: Seiko Epson Corporation, Tokyo (JP)

( * ) Notice: Subject to any disclaimer, the term of this patent is extended or adjusted under 35 U.S.C. 154(b) by 158 days.

(21) Appl. No.: 11/191,982

(22) Filed: Jul. 29, 2005

(65) Prior Publication Data

US 2006/0049767 A1 Mar. 9, 2006

(30) Foreign Application Priority Data

Sep. 9, 2004 (JP) ..... 2004-262188
Mar. 15, 2005 (JP) ..... 2005-072873

(51) Int. Cl.
*H05B 41/16* (2006.01)

(52) U.S. Cl. ..... 315/139; 315/148; 315/337; 315/82; 313/574; 313/581; 313/627

(58) Field of Classification Search ..... 315/103, 315/105, 174, 137, 139, 148, 291, 337, 341, 315/307, DIG. 7, 56, 57, 82; 313/574, 581, 313/584, 585, 620–627, 634, 631
See application file for complete search history.

(56) References Cited

U.S. PATENT DOCUMENTS 2,265,323 A * 12/1941 Spanner ..... 315/266
2,625,671 A * 1/1953 Krefft ..... 315/49
3,766,430 A * 10/1973 Schlegel ..... 315/147
4,912,364 A * 3/1990 Hollo et al. ..... 313/623
5,015,913 A * 5/1991 Pfaue ..... 313/625
6,661,176 B2 * 12/2003 Honda et al. ..... 315/56
6,975,069 B2 * 12/2005 Crandall ..... 313/582

FOREIGN PATENT DOCUMENTS

| | | |
|---|---|---|
| JP | A 64-086442 | 3/1989 |
| JP | A 03-283390 | 12/1991 |
| JP | A 06-325735 | 11/1994 |
| JP | A 2000-048996 | 2/2000 |
| JP | A 2004-039497 | 2/2004 |

* cited by examiner

*Primary Examiner*—Haissa Philogene
(74) *Attorney, Agent, or Firm*—Oliff & Berridge, PLC

(57) ABSTRACT

A discharge tube is driven by a multiple-phase drive circuit, and includes a discharge container having an internal discharge space and multiple electrodes that are secured to the discharge container and correspond to each phase of the multiple-phase drive circuit. The tips of the multiple electrodes protrude into the discharge space, and are oriented toward a predetermined single point of union. All of the electrodes located on one side of a virtual plane that includes the predetermined point of union. Furthermore, a discharge lamp having the discharge tube includes three electrodes, and electric discharge can take place between each pair of electrodes. When the discharge lamp is driven at maximum output, voltage is impressed to the three electrode terminals such that at least one of the voltages VeAB, VeBC, VeCA between the three electrode terminals will be in a discharge period.

12 Claims, 20 Drawing Sheets

CK
A1a
A1b
A1c

A1

A2a

A3a

A4Pa

A4PKa

A5ap
A5an

A6ap

A6an

A7Va

A8Lab,A8Lbc,A8Lca
A8Lab
A8Lbc
A8Lca

Tpr
P11
P12 P1
P2
P3 P4
P5
P6 P7
P8
P9 P10
P11
P12
A1
A2a
A3a
A5ap
A5am
A8Lca
A8Lbc
A8Lab
LIGHT MODULATION
A8Lab,A8Lbc,A8Lca
A5ap
A5am
A8Lab,A8Lbc,A8Lca

DISCHARGE LAMP AND CONTROL OF THE SAME

CROSS REFERENCE TO RELATED APPLICATIONS

The present application claims the priority based on Japanese Patent Application No. 2004-262188 filed on Sep. 9, 2004 and Japanese Patent Application No. 2005-72873 filed on Mar. 15, 2005, the disclosures of which are hereby incorporated herein by reference in their entireties.

BACKGROUND OF THE INVENTION

1. Field of the Invention

The present invention relates to a discharge tube, and more particularly to a technology to drive a discharge tube efficiently and stably. The present invention further relates to the control of a discharge lamp.

2. Description of the Related Art

A discharge lamp having a discharge tube is used as a light source for a projector or other device. This discharge tube may be driven by a single-phase power supply (e.g. JP06-325735A) or a multiple-phase power supply (e.g. JP64-86442A).

A discharge lamp of the conventional art commonly has two electrodes. A discharge lamp control device generally causes discharge lamp illumination by impressing voltage to the two electrodes and creating an electric discharge between the two electrodes. When AC voltage is impressed to this conventional single-phase-driven discharge lamp, the discharge lamp becomes a light source that repeatedly alternates between an illuminated state and a non-illuminated state.

The above conventional discharge tube may fluctuate in its discharge characteristics, and offers insufficient discharge efficiency and stability of output intensity. Furthermore, as a result of the electrodes or the like residing in the light transmission path, the problems of light loss and poor light transmission efficiency may occur.

These problems are not limited to a discharge tube in a discharge lamp used as a projector light source, but are common to general discharge tubes.

In addition, various problems arise due to the fact that the discharge lamp is a light source that repeatedly blinks on and off. For example, where this type of discharge lamp is used in a display device such as a projector, flicker caused by interference between the light source illumination frequency and the display device drive frequency occurs. Furthermore, where this type of discharge lamp that repeatedly blinks on and off is used as an illumination device, flicker caused by interference with the light source illumination frequency of a different light source in the area may occur. Moreover, the discharge frequency may cause stress on the eyes and brain.

It has been considered to impress DC voltage to the electrodes in order to illuminate the discharge lamp. However, if DC voltage is impressed, the load on the electrodes becomes large, thereby shortening their life span.

SUMMARY OF THE INVENTION

A first object of the present invention is to provide a technology to increase the discharge efficiency, output intensity stability and transmission efficiency of a discharge tube.

A second object of the present invention is to provide a technology that generates illumination close to that provided by a DC power supply while supplying energy having a frequency component to a discharge lamp.

In one aspect of the present invention, there is provided a discharge tube driven by a multiple-phase drive circuit. The discharge tube comprises a discharge container and multiple electrodes. The discharge container includes an internal discharge space. The multiple electrodes are secured to the discharge container. Each of the multiple electrodes corresponds to a phase of the multiple-phase drive circuit. Tips of the multiple electrodes protrude inside the discharge space and are oriented toward a predetermined point of union. All of the multiple electrodes are positioned at one side of a virtual plane including the predetermined point of union.

With this discharge tube, because the tips of the multiple electrodes are all oriented toward a predetermined point of union, the light energy created by the electrical discharge between the electrodes can be concentrated, thereby increasing discharge efficiency. Furthermore, because all of the multiple electrodes are positioned at one side of a virtual plane including the predetermined point of union, light loss caused by the electrodes can be minimized and light transmission efficiency can be improved. Moreover, because the discharge tube is driven by a multiple-phase drive circuit, discharge fluctuations are mitigated and output intensity stability can be improved.

In another aspect of the present invention, there is provided an apparatus. The apparatus comprises a discharge lamp control device configured to control a discharge lamp including three or more electrodes for discharging electricity. The discharge lamp control device supplies to the three or more electrodes power signals having a frequency component, and controls supply of the power signals such that discharge occurs between at least two of the electrodes at all times when the discharge lamp is illuminated at maximum output.

With this apparatus, because the supply of power signals is controlled such that discharge occurs between at least two of the electrodes at all times when the discharge lamp is illuminated at maximum output, lighting close to that supplied by a DC power supply can be supplied while output signals having a frequency component are supplied.

The present invention can be realized in a various aspects. For example, the present invention can be realized in aspects such as a discharge tube, a discharge lamp having a discharge tube, a projector having a discharge lamp, an illumination device having a discharge lamp, a discharge lamp control method, an illumination device, a projection-type image display device, a computer program to realize the functions of these methods or devices, or a recording medium or the like on which such program is recorded.

These and other objects, features, aspects, and advantages of the present invention will become more apparent from the following detailed description of the preferred embodiments with the accompanying drawings.

DESCRIPTION OF THE PREFERRED EMBODIMENT

Next, aspects of the present invention will be described in the following order on the basis of embodiments:

A. First embodiment

B. Second embodiment

C. Third embodiment

D. Fourth embodiment

E. Variations

A. First Embodiment

Figure 1:
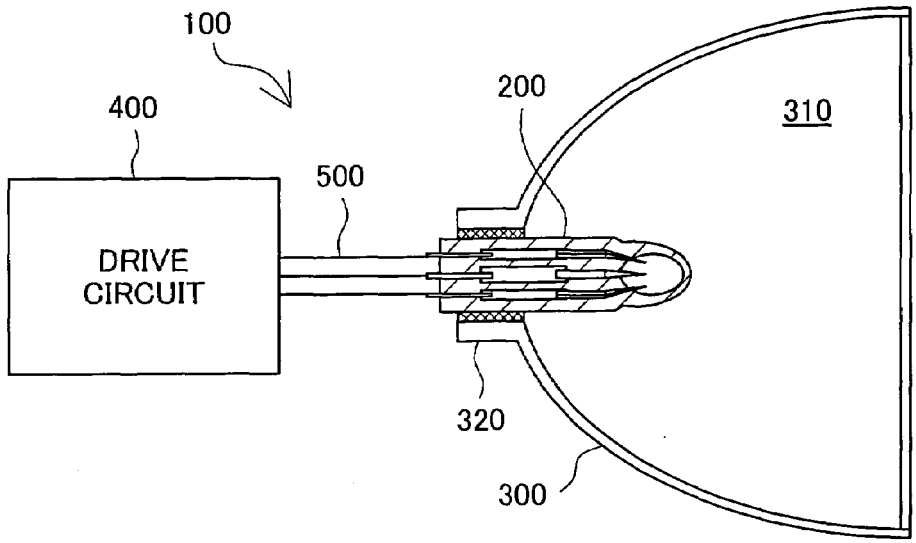
FIG. 1 is an explanatory drawing showing the basic construction of a discharge lamp having a discharge tube in a first embodiment of the present invention.

FIG. 1 is an explanatory drawing showing the basic construction of a discharge lamp having a discharge tube in a first embodiment of the present invention. The discharge lamp 100 includes a discharge tube 200, a reflecting case 300, a drive circuit 400 and a power supply line 500 that connects the discharge tube 200 and the drive circuit 400. The discharge tube 200 is secured to a base portion 320 of the reflecting case 300 such that the tip thereof protrudes inside a hollow space 310 of the reflecting case 300. The hollow space 310 of the reflecting case 300 contains nitrogen gas, for example.

The discharge lamp 100 is used as a projector light source, a vehicle headlight, an illuminating device or the like.

Figure 2A:
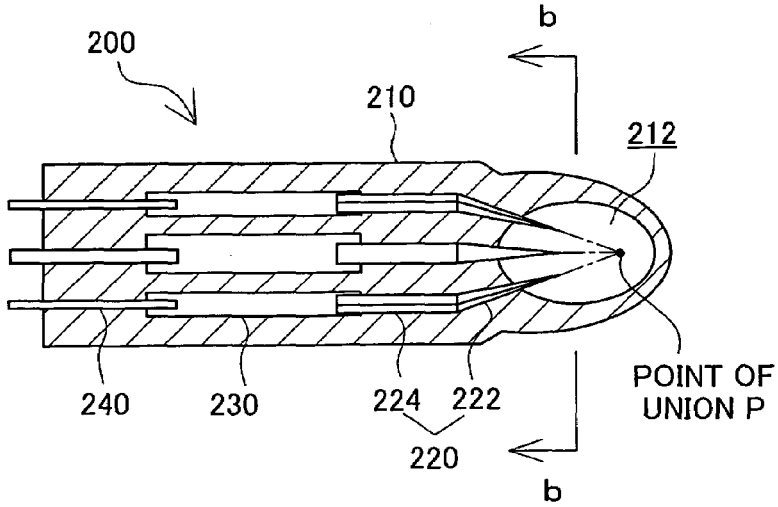
FIGS. 2A and 2B are explanatory drawings showing the detailed construction of the discharge tube in the first embodiment.
Figure 2B:
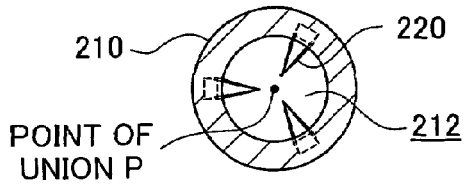

FIGS. 2A and 2B are explanatory drawings showing the detailed construction of the discharge tube in the first embodiment. FIG. 2A shows a horizontal cross-section of the discharge tube 200, while FIG. 2B shows a cross-sectional view cut along the b-b line in FIG. 2A. The discharge tube 200 includes a discharge container 210 that contains an internal discharge space 212. The discharge container 210 is formed in a roughly cylindrical configuration using silica glass, for example. The discharge space 212 is a space that is formed inside one end of the discharge container 210 in a roughly ellipsoidal configuration, and contains mercury and argon gas, for example.

Three electrodes 220, metal foil pieces 230 and external leads 240 are respectively housed inside the discharge container 210. The electrodes 220 and external leads 240 are formed from tungsten, for example, and the metal foil pieces 230 are formed from molybdenum, for example. The three electrodes 220, metal foil pieces 230 and external leads 240 are respectively connected to each other in that sequence thereby forming three separate units. In addition, the three external leads 240 are respectively connected to three power lines 500 (see FIG. 1).

Each of the electrodes 220 has a rod-like configuration, and one end thereof (hereinafter the 'discharge end') protrudes into the discharge space 212 of the discharge container 210. In this embodiment, each electrode 220 comprises a tip portion 222 that includes the discharge end and a body portion 224 that constitutes the remaining part of the electrode 220. The tip portion 222 forms a predetermined angle with the body portion 224. As shown in FIG. 2A, the body portions 224 of the three electrodes 220 are disposed roughly parallel to one another. Furthermore, as shown in FIGS. 2A and 2B, the tip portions 222 of all of the three electrodes 220 are oriented toward a single point (hereinafter termed the 'point of union P'). In the description below, the three electrodes below are referred to as the 'A', 'B' and 'C' electrodes.

Figure 3A:
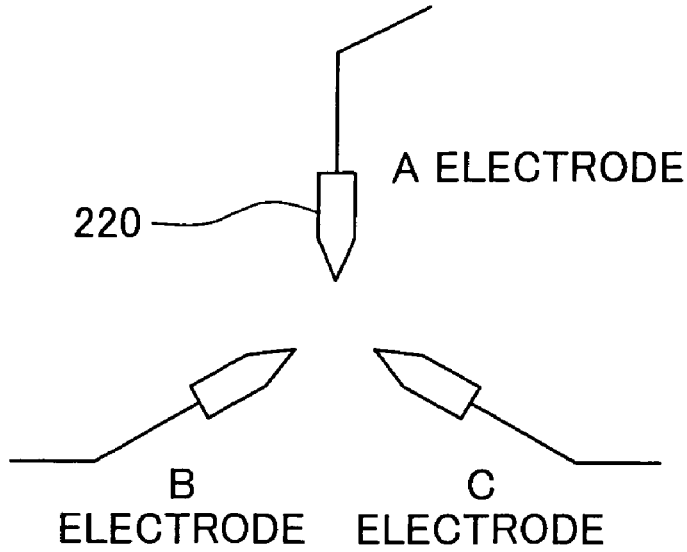
FIGS. 3A and 3B are conceptual drawings of the electrodes of the discharge tube in the first embodiment.
Figure 3B:
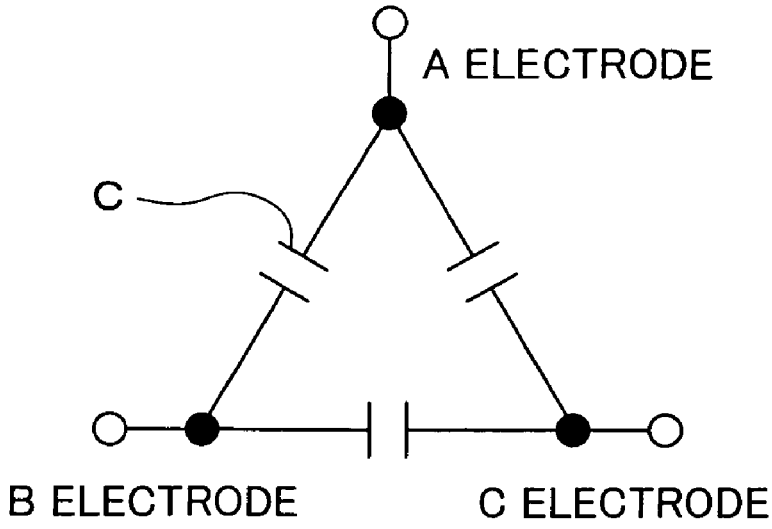

FIGS. 3A and 3B are conceptual drawings of the electrodes of the discharge tube in the first embodiment. The three electrodes 220 (A, B, C) of the discharge tube 200 are disposed as shown in FIG. 3A. This is equivalent to a delta-type electric circuit in which each of the three electrodes 220 is connected to the two other electrodes via capacity C, as shown in FIG. 3B.

Figure 4:
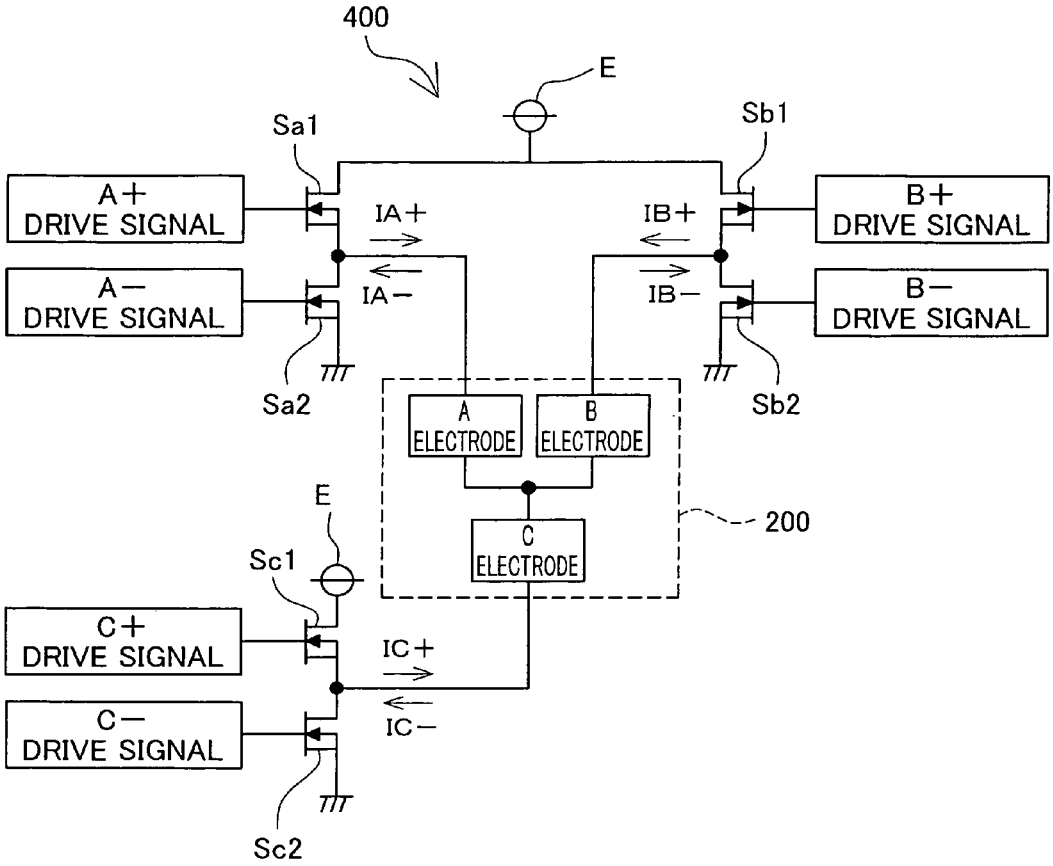
FIG. 4 is an explanatory drawing showing the construction of the drive circuit in the first embodiment.

FIG. 4 is an explanatory drawing showing the construction of the drive circuit in the first embodiment. The drive circuit 400 is a three-phase drive circuit that drives the discharge tube 200 (surrounded by the broken line rectangle in FIG. 4). In FIG. 4, the internal construction of the discharge tube 200 is omitted. The drive circuit 400 has a DC power supply E and six switches (Sa1, Sa2, Sb1, Sb2, Sc1, Sc2). For ease of display in the drawing, the power supply E is shown in two different locations. The power supply E is connected to the A electrode via the switch Sa1, to the B electrode via the switch Sb1, and to the C electrode via the switch Sc1. Drive signals transmitted from a drive signal circuit not shown are respectively input to each switch. The drive signal input to the switch Sa1 is termed the 'A+ drive signal', and similarly, the drive signals input to the switches Sa2, Sb1, Sb2, Sc1, Sc2 are respectively termed the 'A− drive signal', 'B+ drive signal', 'B− drive signal', 'C+ drive signal' and 'C− drive signal'.

Figure 5:
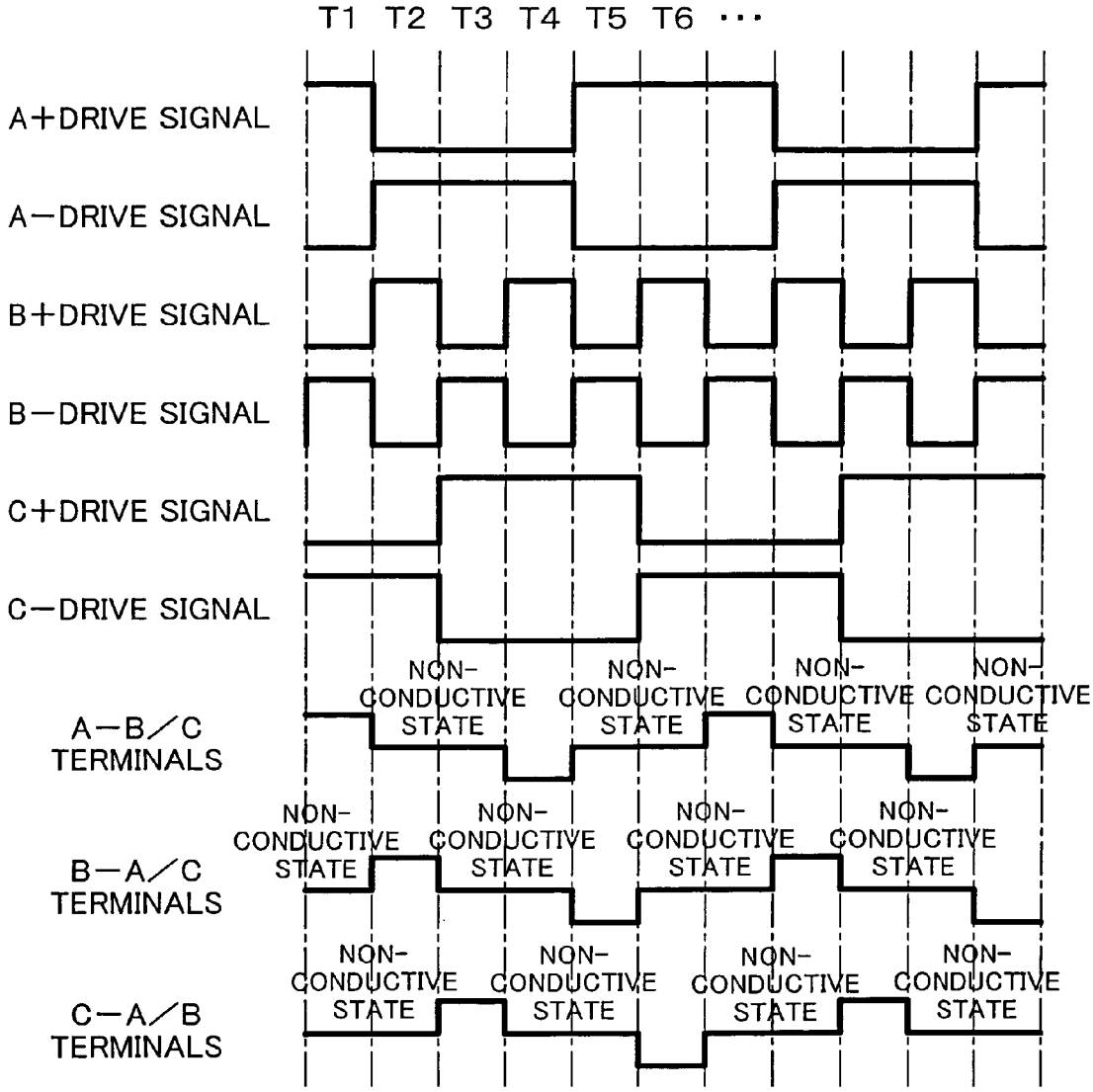
FIG. 5 is a timing chart pertaining to the driving of a discharge lamp using the discharge tube in the first embodiment.
Figure 6:
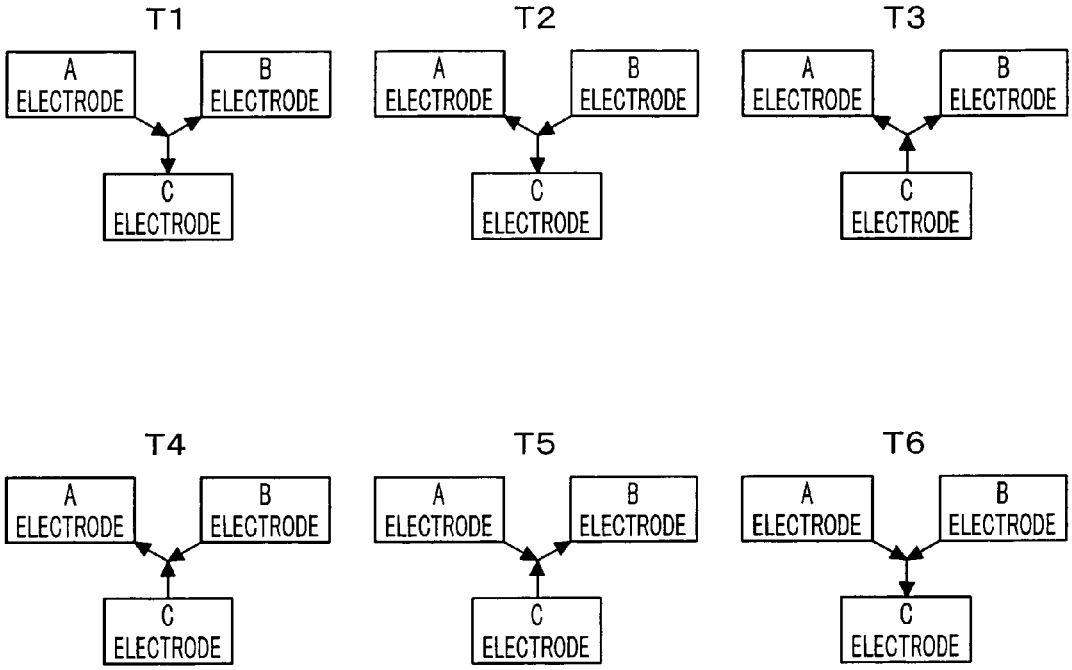
FIG. 6 is an explanatory drawing showing in a conceptual fashion the discharge current formed between each electrode for each timing sequence.

FIG. 5 is a timing chart pertaining to the driving of a discharge lamp using the discharge tube in the first embodiment. FIG. 6 is an explanatory drawing showing in a conceptual fashion the discharge current formed between each electrode for each timing sequence. The symbols T1, T2, . . . shown at the top of FIG. 5 indicate the periods of the timing chart, and correspond to the symbols T1, T2, . . . shown in FIG. 6.

For example, during the period T1 in the timing chart of FIG. 5, the A+, B− and C− drive signals are at H level, while the A−, B+ and C+ drive signals are at L level. During this period, in the circuit shown in FIG. 4, the three switches Sa1, Sb2 and Sc2 are in the ON state, while the remaining three switches Sa2, Sb1 and Sc1 are in the OFF state. As a result, an electric path is formed from the power supply E to the ground terminals of the B and C electrodes via the A electrode. Here, as shown in the drawing indicated by the symbol T1 in FIG. 6, a discharge current is generated from the A electrode toward the B and C electrodes, and current flows in the directions indicated by IA+, IB−, IC− in FIG. 4. During the period T1, there is no discharge from the B electrode to either of the A or C electrodes, or from the C electrode to either of the A or B electrodes, and these paths are in a non-conductive state.

Similarly, during the period T2, for example, the A−, B+ and C− drive signals are at H level, while the A+, B− and C+ drive signals are at L level (see FIG. 5). As a result, in FIG. 4, the switches Sa2, Sb1 and Sc2 enter the ON state and the remaining three switches Sa1, Sb2 and Sc1 enter the OFF state. Therefore, as shown in the drawing indicated by the symbol T2 in FIG. 6, a discharge current is generated from the B electrode toward the A and C electrodes, and current flows in the directions indicated by IA−, IB+, IC− in FIG. 4. The same principle applies with regard to the periods T3 through T6.

In this way, in the discharge tube 200 in the first embodiment, each switch is alternated between the ON and OFF states via drive signals, and electric discharge between the various electrodes 220 takes place while the six states shown in FIG. 6 repeatedly occur. In this case, discharge occurs simultaneously within two pairs of electrodes 220 during all of the periods T1 through T6, as can be seen in FIG. 6. For example, during the period T1, discharge occurs between the electrodes comprising the A electrode/B electrode pair, as well as between the electrodes comprising the A electrode/C electrode pair.

Here, in the discharge tube 200 in this embodiment, as described above with reference to FIG. 2, the tip portions 222 of all three electrodes 220 are oriented toward the point of union P. As a result, the light energy created by the electric discharge between the electrodes 220 can be concentrated, thereby enabling discharge efficiency to be improved.

In the discharge tube 200 in this embodiment, the three electrodes 220 are grouped together at one side of the discharge space 212 of the discharge container 210 (see FIG. 2A). As a result, light loss of the light generated via discharge between the three electrodes 220 due to obstruction from the electrodes 220 or the like can be minimized, and light transmission efficiency can be improved. In the discharge tube 200 in this embodiment in particular, because the body portions 224 of the electrodes 220 are disposed roughly parallel to one another, the presence of objects that obstruct the light in the light transmission path can be eliminated, and light loss can be further minimized.

Furthermore, in the discharge tube 200 in this embodiment, because discharge occurs while the three electrodes 220 are repeating the states shown in FIG. 6, discharge fluctuations can be mitigated and the intensity of the output light can be stabilized. Moreover, because the discharge energy is diffused among three electrodes 220, the life spans of the electrodes 220 can be increased.

In the discharge tube 200 in this embodiment, discharge takes place between the electrodes of two different electrode pairs simultaneously by carrying out driving using a three-phase drive circuit. Consequently, the distances between the electrodes 220 can be reduced accordingly, thereby enabling the discharge start voltage and the discharge startup period to be reduced, resulting in a light source that more closely resembles a single-point light source. In addition, power consumption can be reduced. Furthermore, where a conventional single-phase-driven discharge tube is applied in a projector or other display device, the light source becomes a sinusoidal AC light source and flicker caused by interference between the discharge frequency and the display device drive frequency occurs, but with the discharge tube of this embodiment, the light source can be made close to a DC light source, interference between the discharge frequency and the display device drive frequency can be reduced, and the occurrence of flicker can be minimized. Moreover, driving via the oversampling technique becomes unnecessary, and a low-frequency display device can be realized.

B. Second Embodiment

Figure 7A:
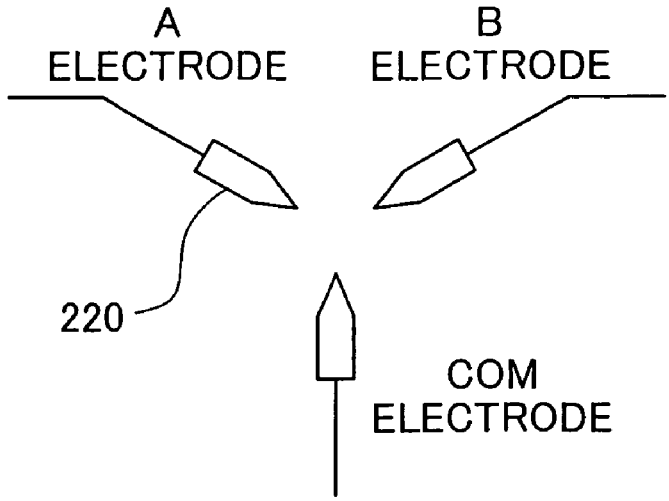
FIGS. 7A and 7B are conceptual drawings of electrodes of a discharge tube in a second embodiment of the present invention.
Figure 7B:
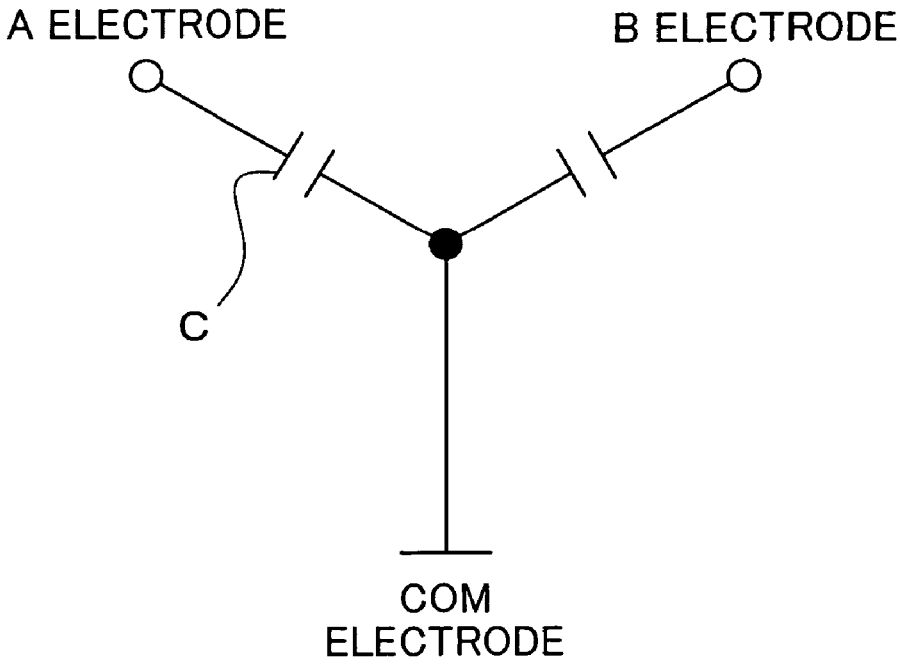

FIGS. 7A and 7B are conceptual drawings of electrodes of a discharge tube in a second embodiment of the present invention. The discharge tube 200 of the second embodiment differs from the first embodiment in that it is driven by a two-phase drive circuit. As a result, the discharge tube 200 in the second embodiment differs from the first embodiment shown in FIG. 3 in that it includes an A electrode, a B electrode and a COM electrode (for 'common'). The three electrodes 220 are disposed in the manner shown in FIG. 7A, and are equivalent to an electric circuit in which the A and B electrodes are each connected to the COM electrode via capacity C as shown in FIG. 7B. The detailed constructions of the discharge lamp 100 in the second embodiment and of the discharge tube 200 in the second embodiment are identical to the equivalent constructions in the first embodiment shown in FIGS. 1 and 2.

Figure 8:
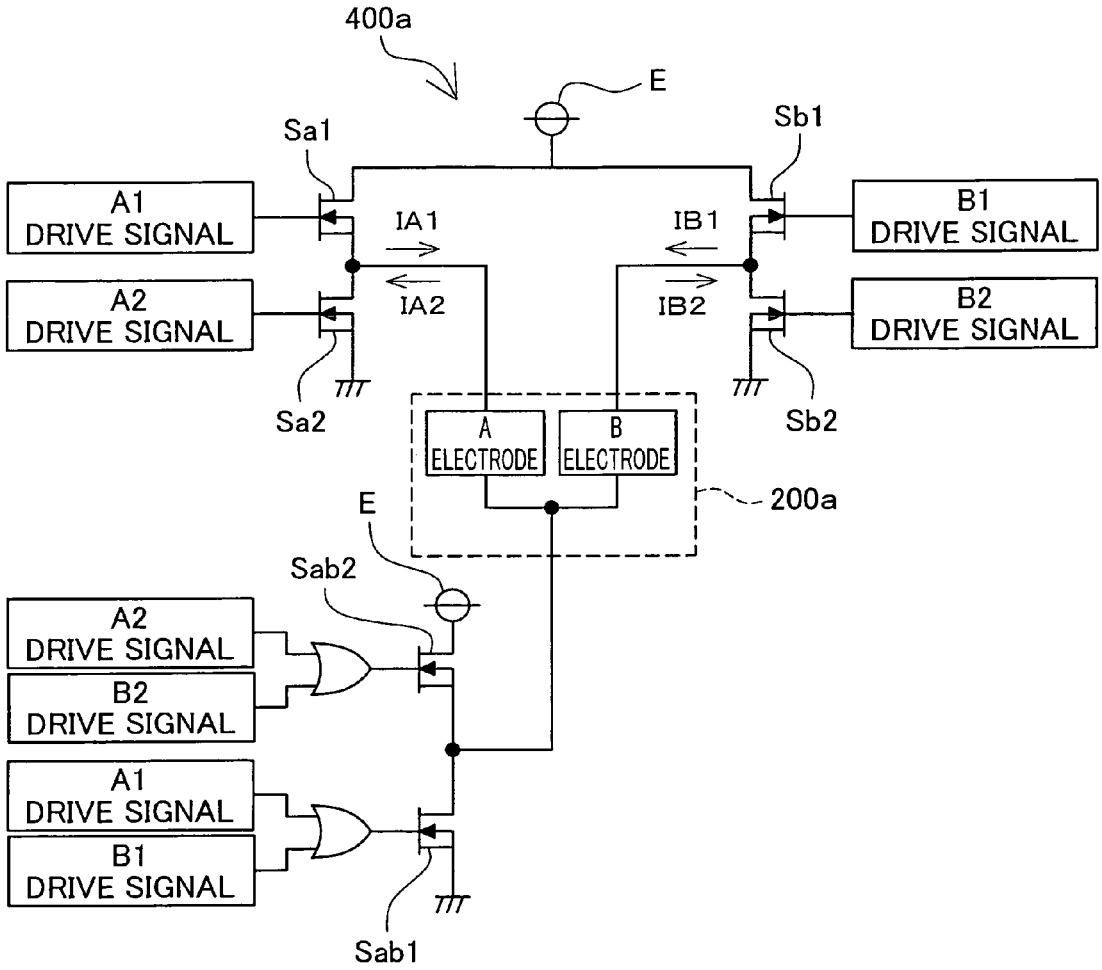
FIG. 8 is an explanatory drawing showing the construction of a drive circuit in the second embodiment.

FIG. 8 is an explanatory drawing showing the construction of a drive circuit in the second embodiment. The drive circuit 400*a* has a DC power supply E and six switches (Sa1, Sa2, Sb1, Sb2, Sab1, Sab2). For ease of display in the drawing, the power supply E is shown in two different locations in FIG. 8. The power supply E is connected to the A electrode via the switch Sa1, to the B electrode via the switch Sb1, and to the COM electrode (see FIG. 7A) via the switch Sab2. Drive signals transmitted from a drive signal circuit not shown are respectively input to each switch. The drive signal input to the switch Sa1 is termed the 'A1 drive signal', and similarly, the drive signals input to the switches Sa2, Sb1, and Sb2 are respectively termed the 'A2 drive signal', 'B1 drive signal' and 'B2 drive signal'. Furthermore, the A1 and B1 drive signals are input to the switch Sab1 via an OR circuit, and the A2 and B2 drive signals are input to the switch Sab2 via an OR circuit.

Figure 9:
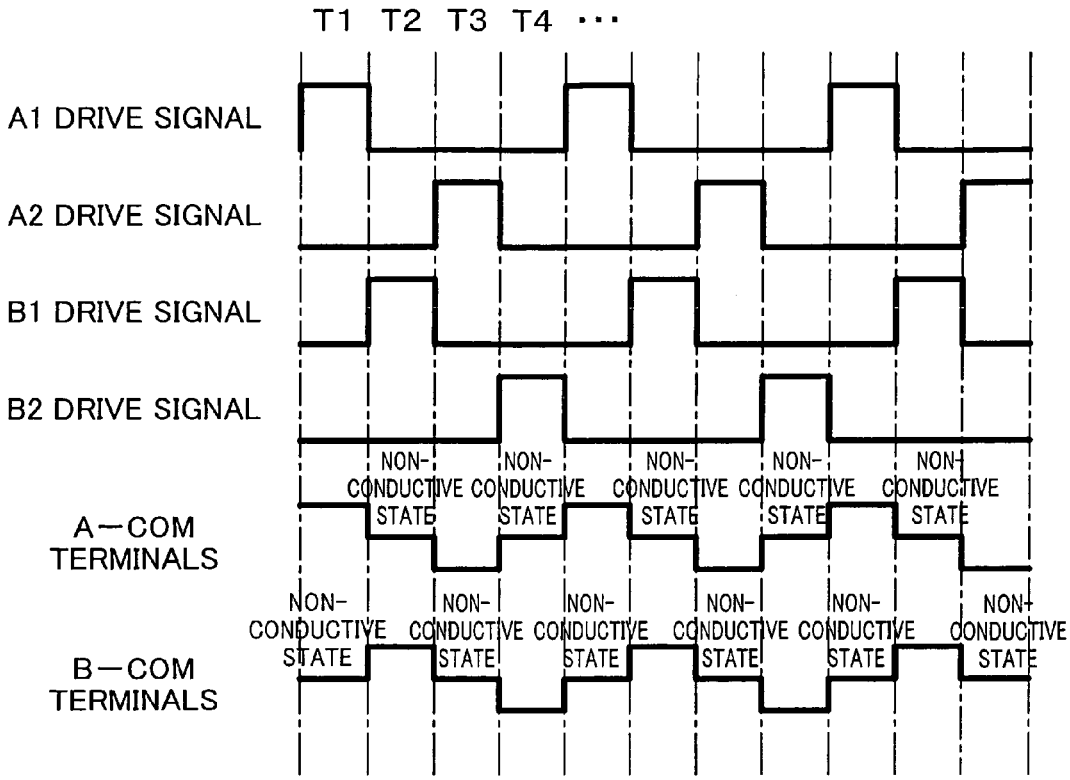
FIG. 9 is a timing chart pertaining to the driving of a discharge lamp using the discharge tube in the second embodiment.

FIG. 9 is a timing chart pertaining to the driving of a discharge lamp using the discharge tube in the second embodiment. The symbols T1, T2, . . . shown at the top of FIG. 9 indicate the periods of the timing chart. For example, during the period T1 in the timing chart of FIG. 9, the A1 drive signal is at H level, while the A2, B1 and B2 drive signals are at L level. During this period, in the circuit shown in FIG. 8, the switches Sa1 and Sab1 are in the ON state, while the remaining four switches Sa2, Sb1, Sb2 and Sab2 are in the OFF state. As a result, an electric path is formed from the power supply E to the ground terminal of the COM electrode via the A electrode. When this occurs, a discharge current is generated from the A electrode toward the COM electrode, and current flows in the direction indicated by IA1 in FIG. 8. During the period T1, there is no discharge from the B electrode to the COM electrode, and this path is in a non-conductive state.

Similarly, during the period T2, for example, the B1 drive signal is at H level, while the A1, A2 and B2 drive signals are at L level (see FIG. 9). As a result, in FIG. 8, the switches Sb1 and Sab1 enter the ON state and the remaining switches enter the OFF state. Therefore, a discharge current is generated from the B electrode toward the COM electrode, and current flows in the direction indicated by IB1 in FIG. 8. The same principle applies with regard to the periods T3 and T4. In the discharge tube 200 in the second embodiment, each switch is alternated between the ON and OFF states via drive signals, and discharge occurs between the various electrodes 220 while the states present during the periods T1 through T4 are repeated.

In the discharge tube 200 in the second embodiment, because all of the tip portions 222 of the three electrodes 220 are oriented toward the point of union P, as in the first embodiment, the light energy created via electric discharge between the electrodes 220 can be concentrated, thereby improving discharge efficiency.

Furthermore, in the discharge tube 200 in the second embodiment, because the three electrodes 220 are grouped at one side of the discharge space 212 of the discharge container 210, light loss can be minimized, thereby improving light transmission efficiency.

Moreover, in the discharge tube 200 in the second embodiment, because discharge occurs between the three electrodes 220 while the state of the electric circuit is being switched by the drive signals shown in FIG. 9, discharge fluctuations can be mitigated and light output intensity can be stabilized in the same manner as in the first embodiment. In addition, because the discharge energy is diffused among the three electrodes, the life spans of the electrodes 220 can be extended.

C. Third Embodiment

Figure 10:
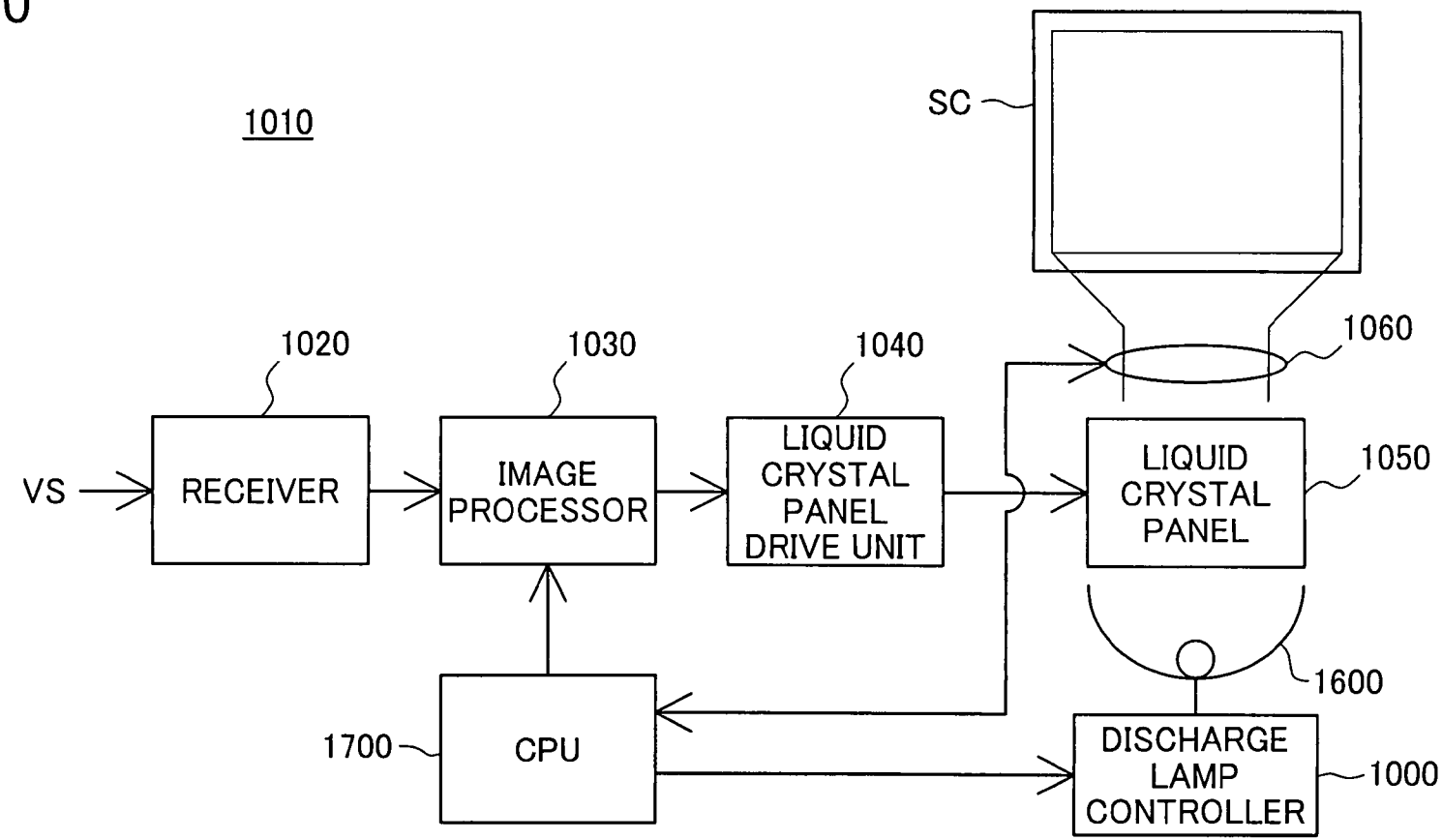
FIG. 10 is an explanatory drawing showing the basic construction of a liquid crystal projector as an embodiment of the projection-type image display device of the present invention.

FIG. 10 is an explanatory drawing showing the basic construction of a liquid crystal projector as an embodiment of the projection-type image display device of the present invention. The liquid crystal projector 1010 includes a receiver 1020, an image processor 1030, a liquid crystal panel drive unit 1040, a liquid crystal panel 1050, a projection optical system 1060 that projects onto a screen SC transmitted light that passes through the liquid crystal panel 1050, and a CPU 1700. The liquid crystal projector 1010 further includes a discharge lamp 1600 that illuminates the liquid crystal panel 1050 and a discharge lamp controller 1000 that controls the discharge lamp 1600.

The receiver 1020 inputs image signals VS supplied from a personal computer or the like not shown and converts them to image data having a format that can be processed by the image processor 1030. The image processor 1030 carries out various types of image processing to the image data input via the receiver 1020, such as brightness adjustment and color balance adjustment. The liquid crystal panel drive unit 1040 generates drive signals to drive the liquid crystal panel 1050 based on the image data that underwent image processing by the image processor 1030. The liquid crystal panel 1050 modulates the illumination light in accordance with the drive signals generated by the liquid crystal panel driver 1040. The projection optical system 1060 includes a projection lens having a zoom function (not shown), and by changing the zoom ratio of this projection lens and varying the focal point, the size of the projected image can be adjusted while maintaining good focus. The liquid crystal panel drive unit 1040, liquid crystal panel 1050, projection optical system 1060 and screen SC are equivalent to the projection display unit of the present invention that carries out projection display using illumination light from the discharge lamp 1600.

The CPU 1700 controls the image processor 1030 and the projection optical system 1060 based on the operation of operation buttons included on a remote controller not shown or on the body of the liquid crystal projector 1010. The CPU 1700 also outputs control signals to the discharge lamp controller 1000, and has a function to set the light modulation values by which the output intensity of the discharge lamp controller 1000 is regulated. This light modulation will be described below.

Figure 11:
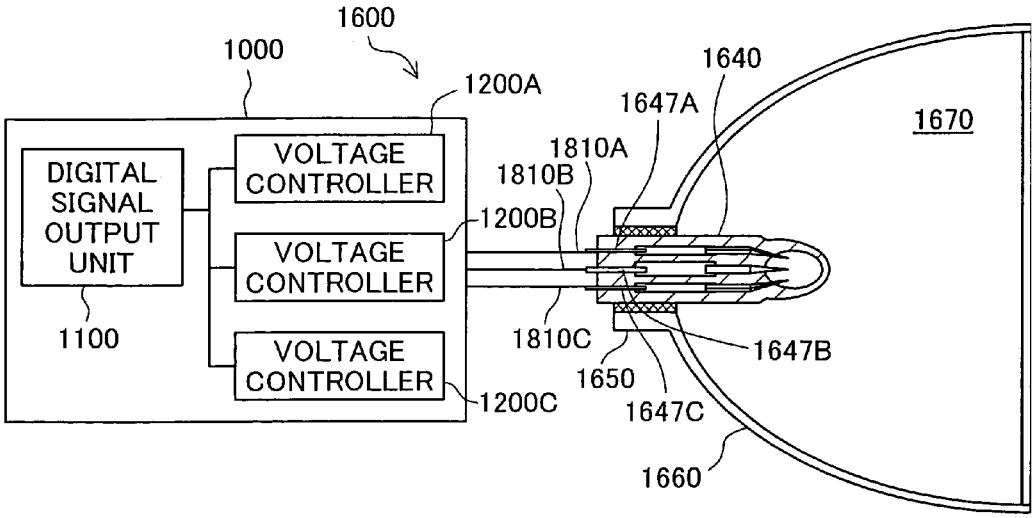
FIG. 11 is an explanatory drawing showing function blocks of the discharge lamp controller 1000 and the construction of the discharge lamp 1600.

FIG. 11 is an explanatory drawing showing function blocks of the discharge lamp controller 1000 and the construction of the discharge lamp 1600. The discharge lamp controller 1000 is connected to the discharge lamp 1600 via three power supply lines 1810A-1810C.

The discharge lamp 1600 includes a discharge tube 1640 and a reflecting case 1660 made of glass having a concave reflecting surface. The discharge tube 1640 is secured to base portion 1650 of the reflecting case 1660 such that the proximal end thereof protrudes into the hollow space 1670 of the reflecting case 1660. The interior of the hollow space 1670 of the reflecting case 1660 contains nitrogen gas, for example.

Figure 12A:
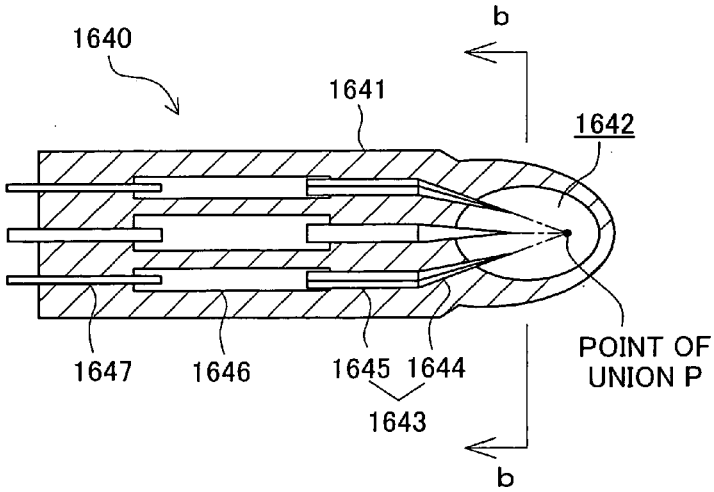
FIGS. 12A and 12B are explanatory drawings showing the detailed construction of the discharge tube 1640.
Figure 12B:
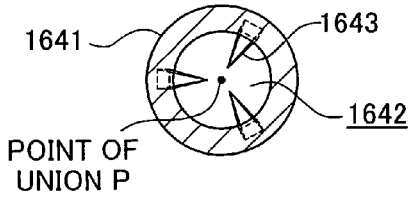

FIGS. 12A and 12B are explanatory drawings showing the detailed construction of the discharge tube 1640. FIG. 12A shows a horizontal cross-section of the discharge tube 1640 while FIG. 12B shows a cross-sectional view cut along the b-b line in FIG. 12B. The discharge tube 1640 includes a discharge container 1641 that has a discharge space 1642 in its interior. The discharge container 1641 is formed in a roughly cylindrical configuration from silica glass, for example. The discharge space 1642 is a roughly ellipsoidal space formed inside one end of the discharge container 1641, and the discharge space 1642 contains mercury and argon gas, for example.

Inside the discharge container 1641 are disposed three electrodes 1643, three metal foil pieces 1646 and three electrode terminals 1647. The electrodes 1643 and electrode terminals 1647 are formed from tungsten, for example, while the metal foil pieces 1646 are formed from molybdenum, for example. The electrodes 1643, metal foil pieces 1646 and electrode terminals 1647 are respectively connected to each other in that sequence. Furthermore, as shown in FIG. 11, the three electrode terminals 1647A-1647C are respectively connected to three power supply lines 1810A-1810C.

Each electrode 1643 has a rod-like configuration, and one end thereof (termed the 'discharge end') protrudes into the discharge space 1642 of the discharge container 1641. In this embodiment, the electrode 1643 comprises a tip section 1644 that includes a discharge tip and a body section 1645 comprising the remainder thereof, and is shaped such that the tip section 1644 forms a predetermined angle with the body section 1645. As shown in FIG. 12A, the body sections 1645 of the three electrodes 1643 are disposed roughly parallel to each other. Furthermore, as shown in FIGS. 12A and 12B, the tip sections 1644 of the three electrodes 1643 are all oriented toward a single hypothetical point (termed the 'point of union P' below). In the description below, the three electrodes 1643 are termed electrodes 'A', 'B' and 'C'.

Figure 13A:
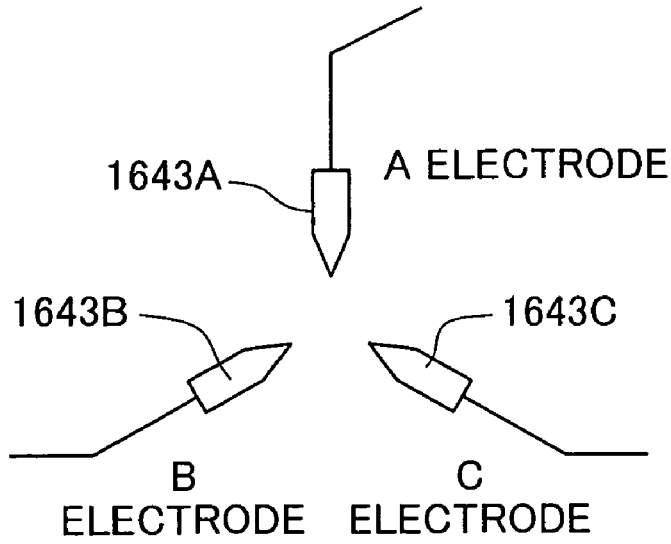
FIGS. 13A and 13B are conceptual drawings of the electrodes of the discharge tube.
Figure 13B:
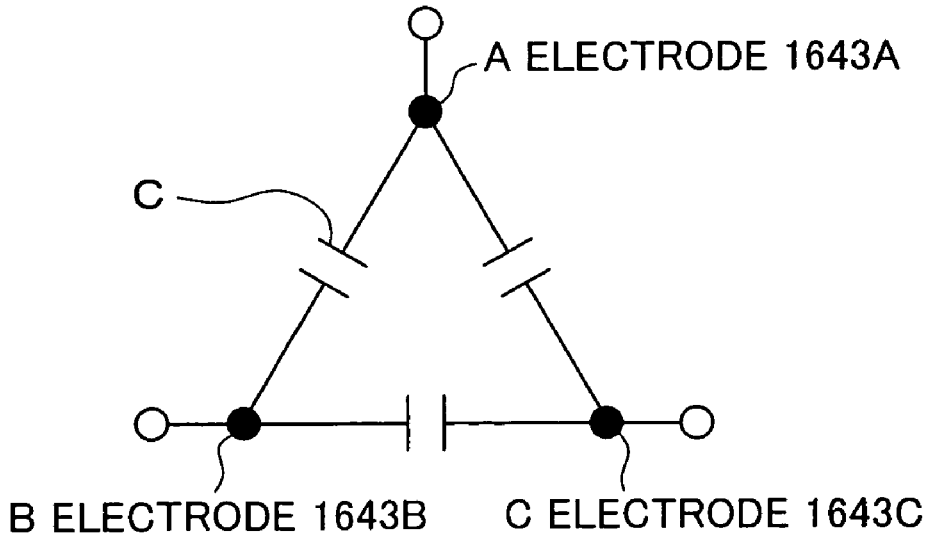

FIGS. 13A and 13B are conceptual drawings of the electrodes of the discharge tube. The electrodes 1643 (A electrode 1643A, B electrode 1643B, C electrode 1643C) are disposed in the manner shown in FIG. 13A. This is equivalent to a delta-type electric circuit in which each of the three electrodes 1643 is connected to the two other electrodes 1643 via capacity C, as shown in FIG. 13B.

As shown in FIG. 11, the discharge lamp controller 1000 includes a digital signal output unit 1100 and three voltage controllers 1200A-1200C, and is configured as a three-phase drive circuit. The digital signal output unit 1100 outputs digital signals indicating the waveforms of the power signals to be supplied to the discharge lamp 1640. The digital signals output by the digital signal output unit 1100 will be described in more detail below. The voltage controllers 1200A-1200C control the voltages respectively impressed to the electrode terminals 1647A-1647C based on the digital signals output by the digital signal output unit 1100. The voltage controllers 1200A-1200C are equivalent to the power signal generators of the present invention.

Figure 14:
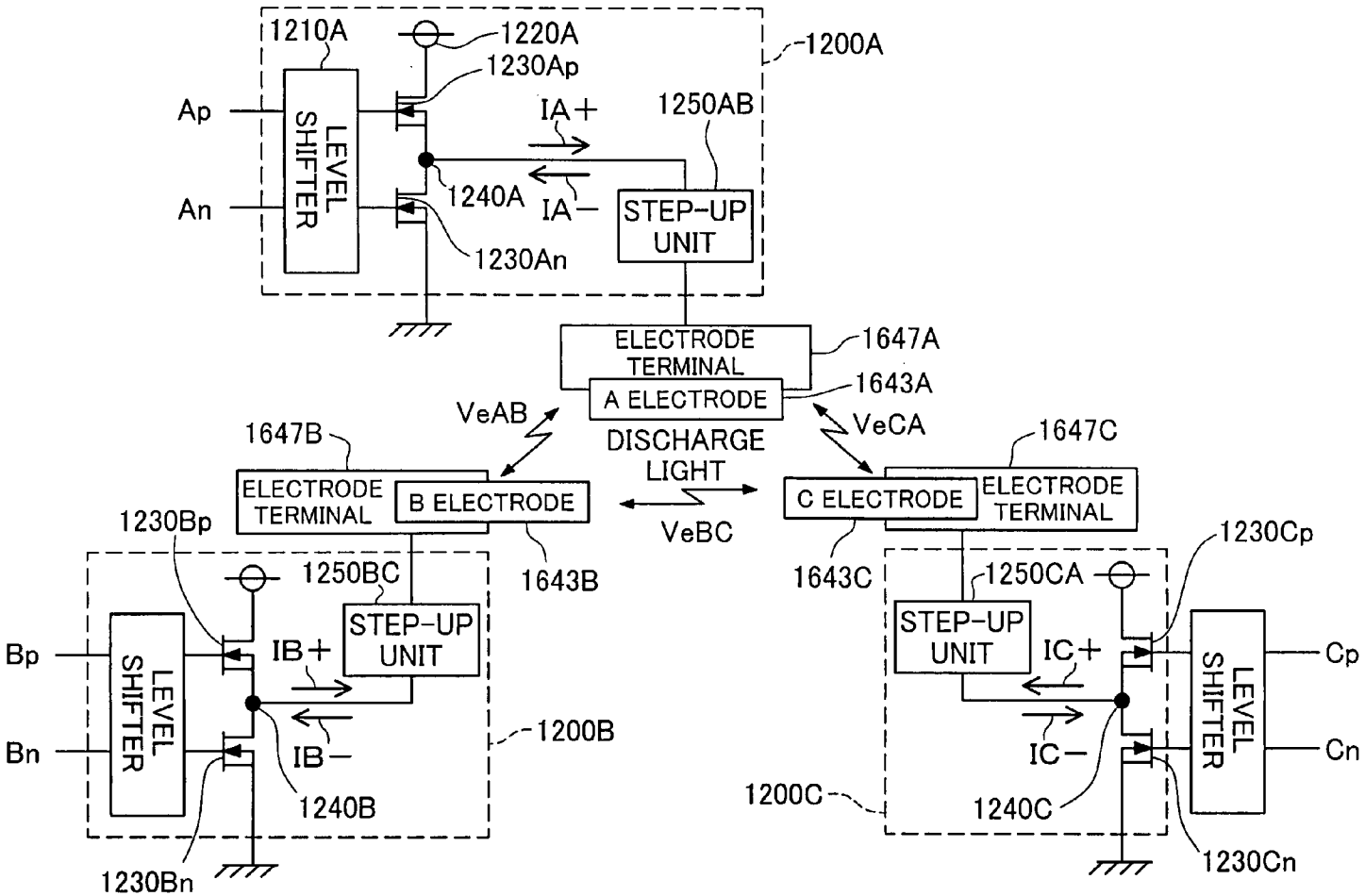
FIG. 14 is an explanatory drawing showing the construction of the voltage controllers 1200A-1200C.

FIG. 14 is an explanatory drawing showing the construction of the voltage controllers 1200A-1200C. The voltage controller 1200A includes a level shifter 1210A, two switching transistors 1230Ap, 1230An, and a step-up unit 1250AB. The level shifter 1210A amplifies the digital signals Ap, An supplied from the digital signal output unit 1100. The first transistor 1230Ap switches between the ON and OFF states based on the value of the first digital signal Ap, and when it is in the ON state, it impresses positive voltage to the electrode terminal 1647A. The second transistor 1230An switches between the ON and OFF states based on the value of the second digital signal An, and when it is in the ON state, it impresses negative voltage to the electrode terminal 1647A. The drive terminal 1240A disposed between the transistors 1230Ap and 1230An is connected to the A electrode 1647A via the step-up unit 1250AB.

Figure 15B:
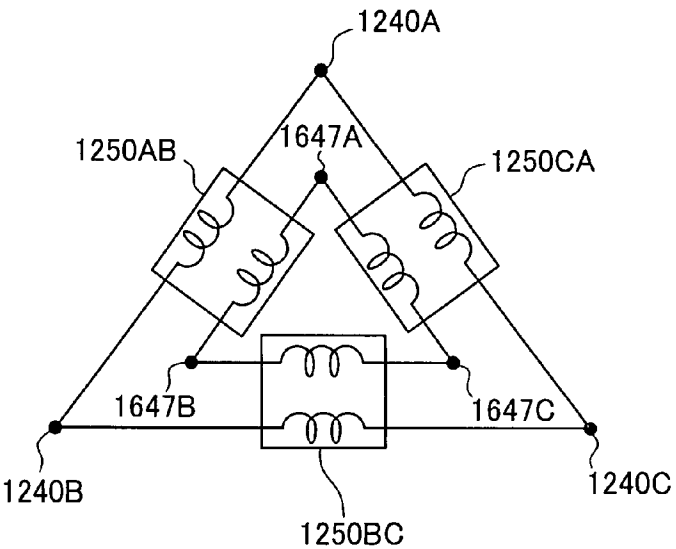
FIGS. 15A and 15B are explanatory drawings showing an example of the construction of a step-up unit 1250AB and the positioning of step-up units 1250AB, 1250BC and 1250CA.
Figure 15A:
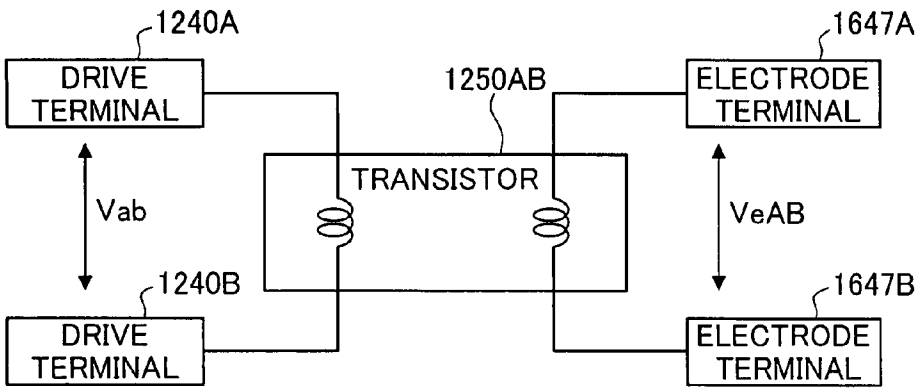

The step-up unit 1250AB is disposed between the drive terminals 1240A, 1240B (see FIG. 14) and the electrode terminals 1647A, 1647B (see FIG. 14), as shown in FIG. 15A and amplifies the voltage Vab between the drive terminals 1240A and 1240B to the level of the voltage VeAB between the electrode terminals 1647A and 1647B. In FIG. 14, the step-up units 1250AB, 1250BC, 1250CA are shown as disposed between one electrode terminal and one drive terminal, but in actuality the step-up units 1250AB, 1250BC, 1250CA are disposed as shown in FIG. 15B. The step-up unit 1250BC amplifies the voltage between the drive terminals 1240B and 1240C to the level of the voltage between the electrode terminals 1647B and 1647C, and the step-up unit 1250CA amplifies the voltage between the drive terminals 1240C and 1240A to the level of the voltage between the electrode terminals 1647C and 1647A. In FIG. 15A, a transformer is shown as an example of the construction of the step-up unit 1250AB.

Figure 16B:
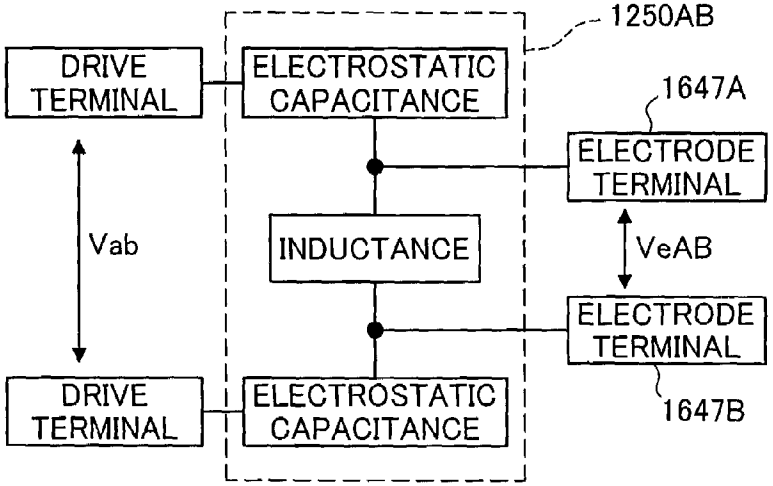
FIGS. 16A and 16B are explanatory drawings showing an example of a different construction for the step-up unit 1250AB.
Figure 16A:
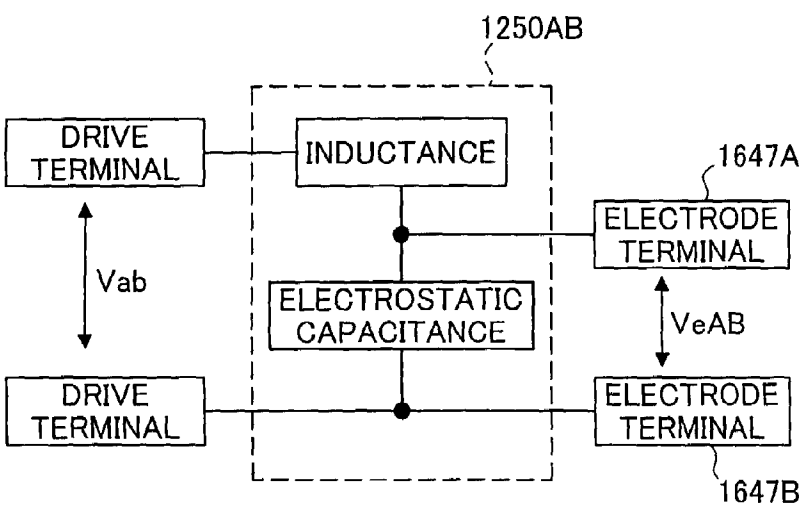

Other examples of the construction of the step-up unit 1250AB are shown in FIGS. 16A and 16B. As shown in FIGS. 16A and 16B, the step-up unit 1250AB may also comprise inductance and electrostatic capacitance.

While the voltage controller 1200A was described with reference to FIG. 14, the voltage controllers 1200B, 1200C have the same construction as the voltage controller 1200A.

Figure 17:
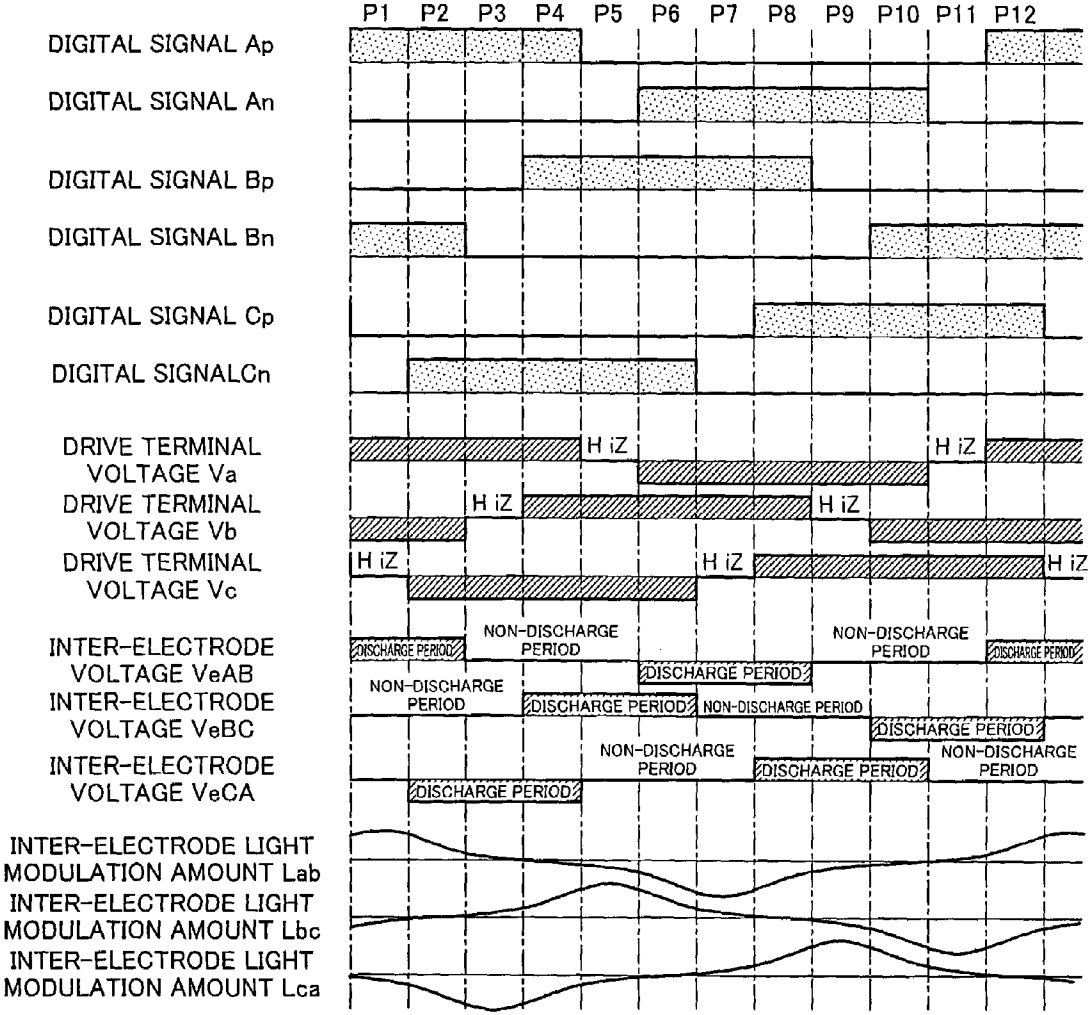
FIG. 17 is a timing chart showing digital signals Ap-Cn output by the digital signal output unit 1100 and changes in voltage corresponding to changes in the digital signals Ap-Cn.
Figure 18:
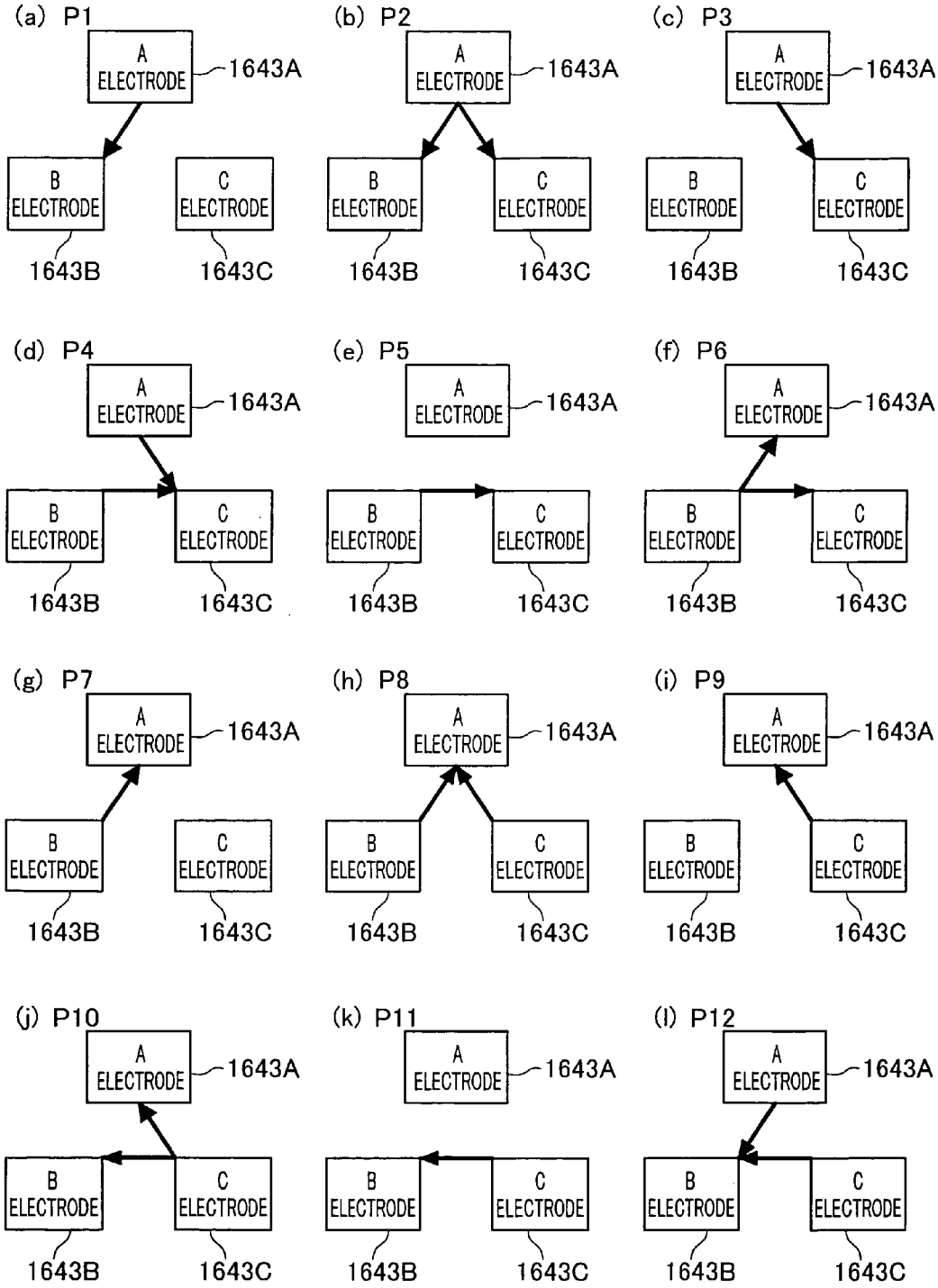
FIG. 18 is an explanatory drawing showing in a conceptual fashion the discharge current formed between each pair of electrodes.

FIG. 17 is a timing chart showing digital signals Ap, An, Bp, Bn, Cp, Cn output by the digital signal output unit 1100 (hereinafter termed 'digital signals Ap-Cn'), and changes in voltage corresponding to changes in the digital signals Ap-Cn. FIG. 18 is an explanatory drawing showing in a conceptual fashion the discharge current formed between each pair of electrodes. The symbols P1, P2, . . . shown at the top of FIG. 17 indicate the periods of the timing chart, and correspond to the symbols P1, P2, . . . shown in FIG. 18. The digital signals Ap-Cn in FIG. 17 are the digital signals Ap-Cn where the discharge lamp 1600 is illuminated at maximum output.

For example, during the period P1 in the timing chart of FIG. 17, the digital signal output unit 1100 outputs signals indicating that the two digital signals Ap, Bn are at H level, as well as signals indicating that the other four digital signals An, Bp, Cp, Cn are at L level. When this occurs, the two transistors 1230Ap, 1230Bn in the circuit shown in FIG. 14 enter the ON state, and the remaining four transistors 1230An, 1230Bp, 1230Cp, 1230Cn enter the OFF state. As a result, an electrical path is formed via the A electrode 1643A from the power supply 1220A to the ground terminal of the B electrode 1643B. When this occurs, discharge current from the A electrode 1643A to the B electrode 1643B is generated as shown by the graphic in FIG. 18 indicated by the symbol P1, and current flows in the directions indicated by IA+, IB− in FIG. 14.

In the drive terminal 1240A shown in FIG. 14, if the voltage of the current traveling in the IA+ direction is deemed positive voltage, and the voltage of the current traveling in the IA− direction is deemed negative voltage, the voltage Va of the drive terminal 1240A is positive during the period P1 (see FIG. 17). On the other hand, in the drive terminal 1240B, if the voltage of the current traveling in the IB+ direction is deemed positive voltage, and the voltage of the current traveling in the IB− direction is deemed negative voltage, the voltage Vb of the drive terminal 1240B is negative during the period P1 (see FIG. 17). Accordingly, the voltage VeAB between the electrode 1643A and the electrode 1643B (termed the 'inter-electrode voltage VeAB' below) is positive (see FIG. 17).

Similarly, during the period P2 in the timing chart of FIG. 17, the digital signal output unit 1100 outputs signals indicating that the three digital signals Ap, Bn, Cn are at H level and the other three digital signals An, Bp, Cp are at L level. When this occurs, in the circuit shown in FIG. 14, the three transistors 1230Ap, 1230Bn, 1230Cn enter the ON state, and the remaining transistors 1230An, 1230Bp, 1230Cp enter the OFF state. As a result, electrical paths from the power supply 1220A to the ground terminals of the B electrode 1643B and the C electrode 1643C are formed via the A electrode 1643A. When this occurs, discharge current from the A electrode 1643A to the B electrode 1643B and the C electrode 1643C is generated as shown by the graphic in FIG. 18 indicated by the symbol P2, and current flows in the directions indicated by IA+, IB−, IC− in FIG. 14.

The voltage Va of the drive terminal 1240A in FIG. 14 is positive during the period P2 (see FIG. 17). On the other hand, the voltage Vb of the drive terminal 1240B is negative during the period P2 (see FIG. 17). In the drive terminal 1240C shown in FIG. 14, if the voltage of the current traveling in the IC+ direction is deemed positive voltage, and the voltage of the current traveling in the IC− direction is deemed negative voltage, the voltage Vc of the drive terminal 1240C is negative during the period P2 (see FIG. 17). Accordingly, the inter-electrode voltage VeAB is positive, and the voltage VeCA between the electrode 1643C and the electrode terminal 1643A (hereinafter termed the 'inter-electrode voltage VeCA') is negative (see FIG. 17). The same is true during the periods P3-P12.

In this way, the voltage controllers 1200A-1200C control the inter-electrode voltage VeAB, the voltage VeBC between the electrode 1643B and the electrode terminal 1643C (hereinafter termed the 'inter-electrode voltage VeBC'), and the inter-electrode voltage VeCA based on the digital signals Ap-Cn output by the digital signal output unit 1100. The sizes of the discharge light amount Lab between the electrode 1643A and the electrode terminal 1643B (hereinafter termed the 'inter-electrode discharge light amount Lab'), the discharge light amount Lbc between the electrode 1643B and the electrode 1643C (hereinafter termed the 'inter-electrode discharge light amount Lbc'), and the discharge light amount Lca between the electrode 1643C and the electrode 1643A (hereinafter termed the 'inter-electrode discharge light amount Lca') fluctuate according to fluctuations in the inter-electrode voltages VeAB, VeBC, VeCA, as shown in a summary fashion in FIG. 17.

The discharge lamp controller 1000 in the third embodiment can carry out light modulation. The digital signal output unit 1100 shown in FIG. 11 stores in advance digital signals Ap-Cn corresponding to light modulation values. When a light modulation value is received from the CPU 1700, the digital signal output unit 1100 outputs digital signals Ap-Cn in accordance with the light modulation value. Specifically, where a light modulation value that makes the inter-electrode discharge light amounts Lab, Lbc, Lca smaller than the maximum output is received, the digital signal output unit 1100 outputs digital signals Ap-Cn that are at H level for a period shorter than that in the maximum output example shown in FIG. 17. Because the period during which the digital signals Ap-Cn are at H level is shorter, the discharge period for the inter-electrode voltages VeAB, VeBC, VeCA also becomes shorter. Therefore, the inter-electrode discharge light amounts Lab, Lbc, Lca become smaller.

With the discharge lamp controller 1000 in this embodiment, a voltage that has a frequency component, i.e., a voltage in which the illuminated state and the non-illuminated state are repeatedly alternated, is impressed to each electrode 1643, as can be seen from the drive terminal voltages Va, Vb, Vc. However, as can be seen from the inter-electrode voltages VeAB, VeBC, VeCA, during all of the periods (P1-P12), discharge is occurring between at least two of the three electrodes (i.e., the A electrode 1643A, the B electrode 1643B and the C electrode 1643C) at all times. Therefore, an illumination state close to that supplied by a DC power supply can be created even while a voltage having a frequency component is being impressed to each electrode 1643. As a result, interference between the discharge frequency and the liquid crystal panel 1050 drive frequency can be reduced, and the occurrence of flicker can be minimized. Furthermore, while the liquid crystal panel 1050 is ordinarily driven using a double-speed conversion technology to minimize flicker, the need for double-speed driving is eliminated, and a low-frequency display device can be realized.

According to the discharge lamp controller 1000 in this embodiment, because the discharge energy is diffused among the three electrodes 1643A, 1643B, 1643C, the life spans of the three electrodes 1643A, 1643B, 1643C can be extended. As can be seen from the inter-electrode voltages VeAB, VeBC, VeCA, because each electrode 1643A, 1643B, 1643C has non-discharge periods comprising periods during which discharge does not occur, the load on the three electrodes 1643A, 1643B, 1643C can be further reduced.

In this embodiment, because periods P5 and P11 during which both of the two digital signals Ap, An for the A electrode enter the L level exist between the periods at which the signals are at H level, there is no possibility that the two transistors 1230Ap, 1230An for the A electrode in FIG. 14 will be ON at the same time. As a result, damage to the transistors 1230Ap, 1230An caused by the impression of voltage from the power supply 1220A thereto can be prevented. The same is true for the transistors 1230Bp, 1230Bn, 1230Cp, 1230Cn.

Moreover, in this embodiment, because the supply of energy to the electrodes is based on digital signals Ap-Cn, control is easy. Furthermore, because the discharge lamp controller 1000 comprises a digital circuit, the circuit can be made compact. In this embodiment, there is only one digital signal output unit 1100, but it is acceptable if there is a separate and independent digital signal output unit 1100 for each of the voltage controllers 1200A-1200C. Furthermore, light modulation can be performed using the discharge lamp controller 1000 of this embodiment.

D. Fourth Embodiment

Figure 19:
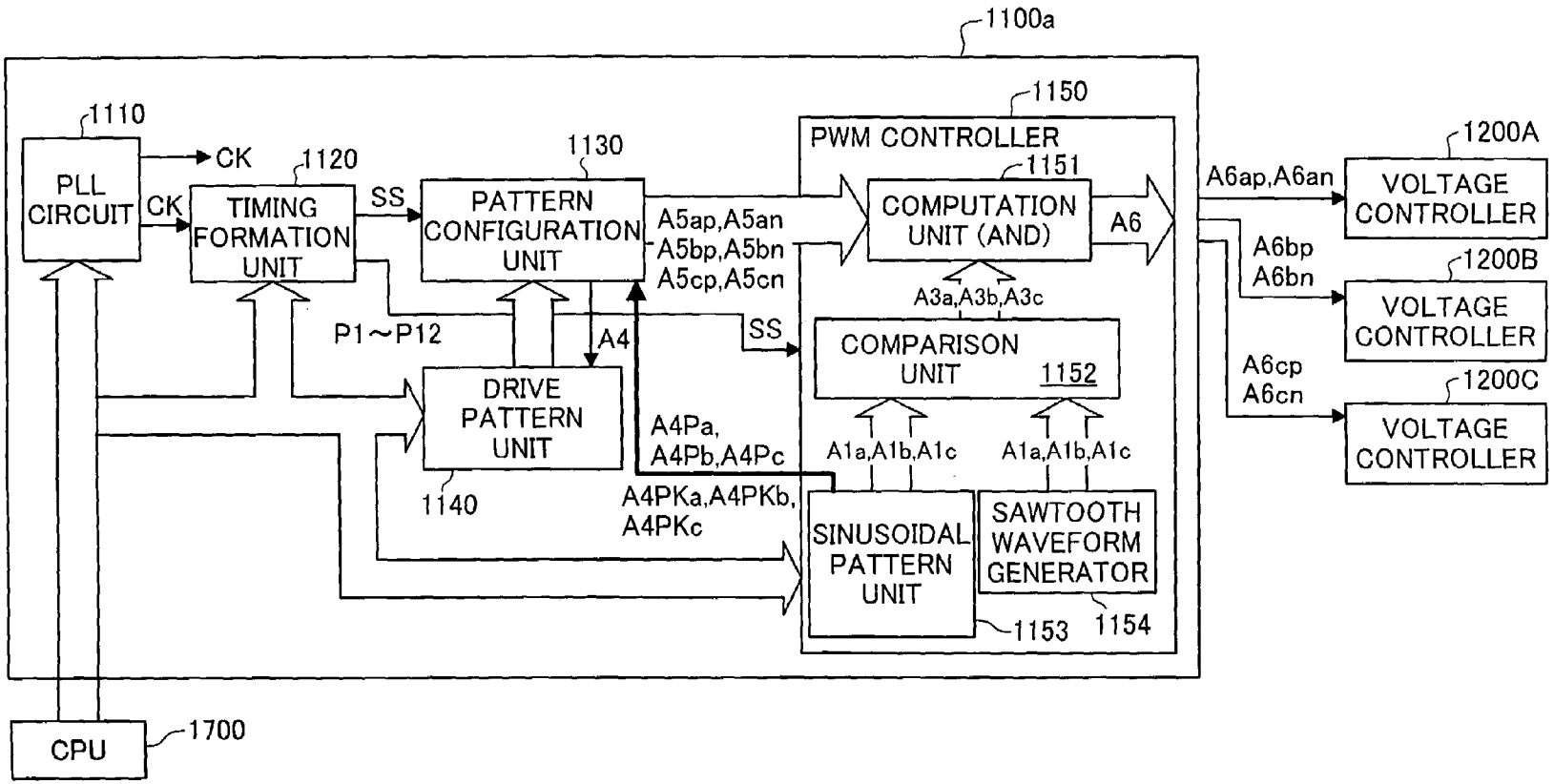
FIG. 19 is a block diagram showing the digital signal output unit 1100*a* in a fourth embodiment.

FIG. 19 is a block diagram showing the digital signal output unit 1100*a* in a fourth embodiment. The fourth embodiment differs from the third embodiment only in regard to the construction of the digital signal output unit 1100*a*, and is otherwise identical to the third embodiment. The digital signal output unit 1100*a* includes a PLL circuit 1110, a timing formation unit 1120, a pattern configuration unit 1130, a drive pattern unit 1140 and a PWM controller 1150. The PWM controller 1150 includes a computation unit 1151, a comparison unit 1152, a sinusoidal pattern unit 1153 and a sawtooth waveform generator 1154. The CPU 1700 executes comprehensive control over the operation of each of these units. Furthermore, the CPU 1700 has a function to set the light modulation values used by the digital signal output unit 1100*a*. The CPU 1700 is equivalent to the light modulation value setting unit of the present invention.

Figures 20A, 20B, 20C, 20D, 20E, 20F, 20G, 20H, 20I, 20J, 20K, 20L:
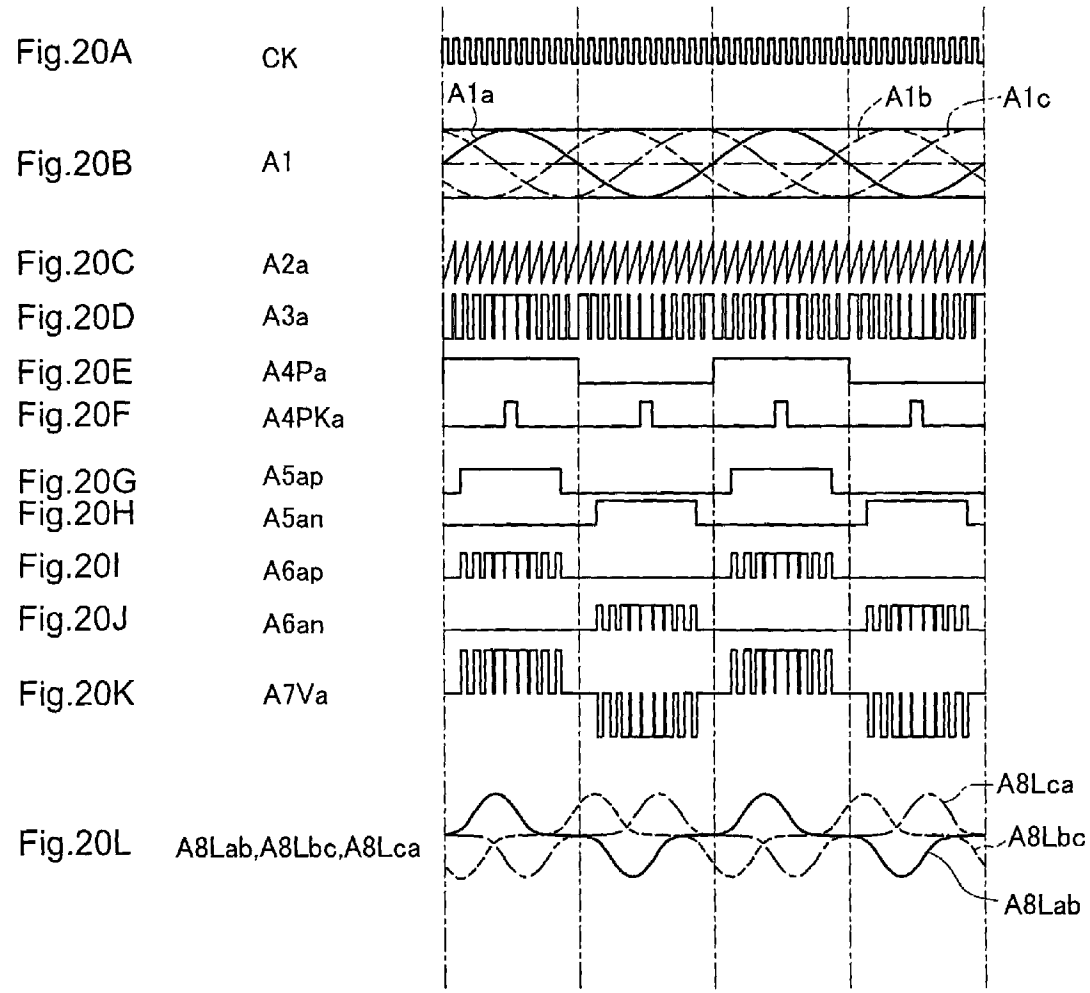
FIGS. 20A to 20L are timing charts showing signals output by the digital signal output unit 1100*a;*

The PLL circuit 1110 outputs a clock signal CK to other circuits. The timing formation unit 1120 outputs to the pattern configuration unit 1130 and the PWM controller 1150 a synchronization signal SS to synchronies the pattern configuration unit 1130 and the PWM controller 1150. FIGS. 20A to 20L are timing charts showing signals output by the digital signal output unit 1100*a*. FIG. 20A shows the clock signal CK.

The sinusoidal pattern unit 1153 counts the number of clock signal CK pulses and generates three sinusoidal signals A1*a*, A1*b*, A1*c* (hereinafter collectively referred to as the 'sine waves A1') (see FIG. 20B). The mutual phase difference of the three sinusoidal signals A1*a*, A1*b*, A1*c* is 120 degrees.

The sawtooth waveform generator 1154 generates sawtooth waveform signals A2*a*, A2*b*, A2*c* for the three sinusoidal signals A1*a*, A1*b*, A1*c* (see FIG. 20C). Because the mutual phase difference of the three sawtooth waveform signals A2*a*, A2*b*, A2*c* is also 120 degrees, the sawtooth waveform signals A2*b*, A2*c* are not shown in the drawing. The signals A3-A6 below also include three different signals like the sinusoidal signals A1, but because the mutual phase difference of the three signals is 120 degrees, only one signal is shown, and the other two signals are omitted from the drawing. The sinusoidal pattern unit 1153 and the sawtooth waveform generator 1154 are equivalent to the waveform generator of the present invention.

The comparison unit 1152 compares the sinusoidal signal A1*a* and sawtooth waveform signal A2*a*and generates a PWM signal A3*a* (see FIG. 20D). PWM signals A3*b*, A3*c* are generated in the same fashion. The comparison unit 1152 is equivalent to the first PWM signal generator of the present invention.

The sinusoidal pattern unit 1153 also generates sinusoidal pattern signals A4Pa, A4Pb, A4Pc, as well as sinusoidal peak signals A4PKa, A4PKb, A4PKc. In the discussion below, the sinusoidal pattern signals A4Pa, A4Pb, A4Pc together with the sinusoidal pattern signals A4PKa, A4PKb, A4PKc are collectively referred to as 'pattern signals A4'. As shown in FIG. 20E, the pattern signal A4Pa is a signal indicating whether or not the sinusoidal signal A1*a* is positive or negative. As shown in FIG. 20F, the sinusoidal peak signal A4PKa is a signal indicating the phase at which the sinusoidal signal A1*a* reaches its peak.

The pattern configuration unit 1130 transmits to the drive pattern unit 1140 the pattern signals A4 sent from the sinusoidal pattern unit 1153. Based on these pattern signals A4, the drive pattern unit 1140 determines which of the periods P1-P12 in FIG. 17 is present, and outputs a signal that indicates that period (i.e., a signal that indicates which of the periods P1-P12 is present, hereinafter termed a 'period ID signal') to the pattern configuration unit 1130.

The pattern configuration unit 1130 stores the waveform patterns of the digital signals Ap-Cn in FIG. 17, and outputs the digital signals A5*ap*, A5*an*, A5*bp*, A5*bn*, A5*cp*, A5*cn* having the same waveforms as the digital signals Ap-Cn based on the period ID signal input from the drive pattern unit 1140 (see FIGS. 20G, 20H).

The computation unit 1151 performs AND computation of the PWM signal A3*a* and the digital signal A5*ap* and outputs the result as a drive signal A6*ap* (see FIG. 20I). It also performs AND computation of the PWM signal A3*b* and the digital signal A5*an* and outputs the result as a drive signal A6*an* (see FIG. 20J). The digital signals A5*ap*, A5*an* are set such that they mask the PWM signal A3*a* within a time range that is symmetrical around the timing at which the sinusoidal signal A1*a* changes from positive to negative or vice versa. The computation unit 1151 performs the identical processing with regard to the other PWM signals A3*b*, A3*c*, and outputs drive signals A6*bp*, A6*an*, A6*cp*, A6*cn*. The pattern configuration unit 1130 and computation unit 1151 are equivalent to the second PWM signal generator of the present invention.

The drive signals A6*ap*, A6*an* are output to the voltage controller 1200A shown in FIG. 14. In other words, the drive signal A6*ap* is supplied to the gate of the transistor 1230Ap, while the drive signal A6*an* is supplied to the gate of the transistor 1230An. When this takes place, the voltage A7Va of the drive terminal 1240A varies as shown in FIG. 20K. Furthermore, the drive signals A6*bp*, A6*bn* are output to the voltage controller 1200B and the drive signals A6*cp*, A6*cn* are output to the voltage controller 1200C in the same fashion. As a result, the voltage A7Va of the drive terminal 1240A, the voltage of the drive terminal 1240B (not shown) and the voltage of the drive terminal 1240C (not shown) come to have a mutual phase difference of 120 degrees.

FIG. 20L shows changes in the three inter-electrode discharge light amounts A8Lab, A8Lbc, A8Lca. The inter-electrode discharge light amounts A8Lab, A8Lbc, A8Lca are the discharge amounts between the electrode pairs 1643A/1643B, 1643B/1643C, and 1643C/1643A.

The digital signal output unit 1100*a* in the fourth embodiment can perform light modulation. The light modulation method used may comprise any of the following methods, for example.

1. First Light Modulation Method

For example, in order to reduce the inter-electrode discharge light amounts A8Lab, A8Lca, the amplitude of the sinusoidal signal A1*a* is reduced. When this is done, because the duty ratio of the PWM signal A3*a* becomes smaller, the duty ratio of the voltage A7Va generated by masking the PWM signal A3*a* via the digital signals A5*ap*, A5*an* also becomes smaller, and the inter-electrode discharge light amounts A8Lab, A8Lca respectively become smaller. In order to reduce the inter-electrode discharge light amount A8Lbc as well, the amplitude of the sinusoidal signal A1*b* or A1*c* is reduced in the same fashion.

2. Second Light Modulation Method

Figures 21A, 21B, 21C, 21D, 21E, 21F, 21G, 21H, 21I:
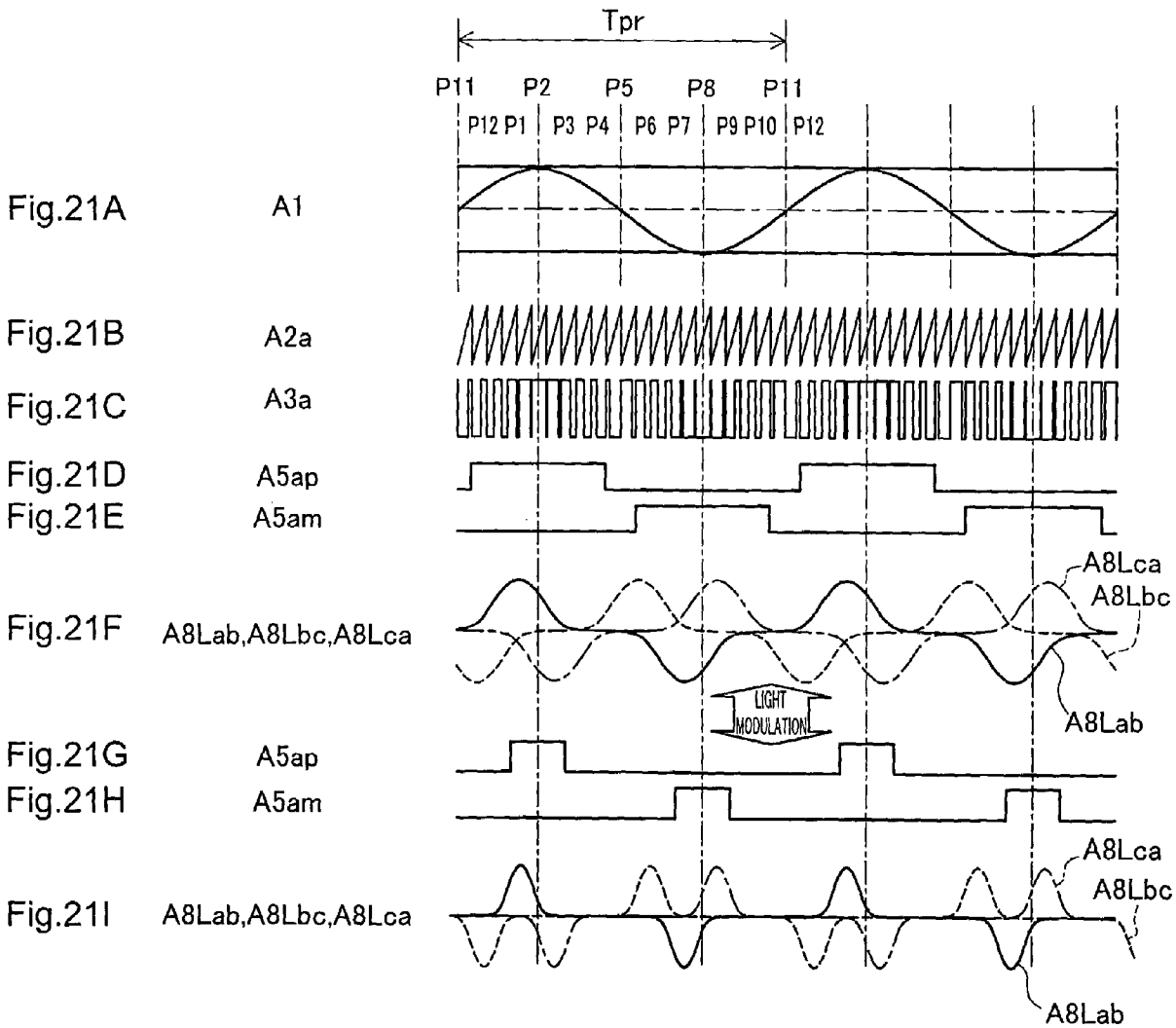
FIGS. 21A to 21I are explanatory drawings showing a second light modulation method.

FIGS. 21A to 21I show a second light modulation method. In the second light modulation method, the pattern configuration unit 1130 shown in FIG. 19 stores in advance digital signals A5*ap*-A5*cn* corresponding to light modulation values. When a light modulation value is received from the CPU 1700, the pattern configuration unit 1130 outputs digital signals A5*ap*-A5*cn* corresponding to this light modulation value. Specifically, where a light modulation value that reduces the inter-electrode discharge light amounts A8Lab, A8Lbc, A8Lca is received, the pattern configuration unit 1130 outputs digital signals A5*ap*-A5*cn* having a small duty ratio (see FIGS. 21G, 21H). Because the duty ratio of the digital signals A5*ap*-A5*cn* is small, the duty ratio of the drive signals A6*ap*-A6*cn* generated by masking the PWM signal A3*a* via the digital signals A5*ap*-A5*cn* is reduced. Consequently, the duty ratio of the voltage A7Va is reduced. Therefore, the inter-electrode discharge light amounts A8Lab, A8Lbc, A8Lca respectively become smaller, as shown in FIG. 21I.

When light modulation is performed, the digital signals A5*ap*, A5*an* are set such that they mask the PWM signal A3*a* within a time range that is symmetrical with respect to the timing at which the sinusoidal signal A1 changes from positive to negative or vice versa. Furthermore, the start time and end time of the cycle Tpr shown in FIG. 21A are equivalent to the point in time represented by the center of the period P11 shown in FIG. 17.

As described above, according to the digital signal output unit 1100*a* in the fourth embodiment, the discharge lamp 1600 can be controlled via PWM control. Furthermore, by using the computation unit 1151 to mask the PWM signal A3*a* via the digital signals A5*ap*, A*an*, a non-discharge period in which no discharge occurs can be easily included. Moreover, according to the digital signal output unit 1100*a* in the fourth embodiment, light modulation can be performed using two different light modulation methods. In the second light modulation method, light modulation can be easily performed by adjusting the H level period of the digital signals A5*ap*, A*an* and by masking the PWM signal A3*a* in accordance with the light modulation value.

In the second light modulation method, the computation unit 1151 performs light modulation by masking the PWM signal A3*a* using the digital signals A*ap*, A5*an*, but the light modulation method is not limited to this method, and light modulation may be performed by masking the sinusoidal signal A1 or some other signal comprising a reference level of voltage impressed to the discharge lamp. In this case, it is preferred that the signal generated from masking be converted to a PWM signal.

The digital signals A5*ap*, A5*an* are set such that the PWM signal A3 is masked within a time range that is symmetrical with respect to the timing at which the sinusoidal signal A1 changes from positive to negative or vice versa. The same is true during light modulation. However, the digital signals A5*ap*, A5*an* are not limited to this setting, and may be set to mask any desired period of the PWM signal A3*a*.

Furthermore, the reference waveform signal used for generating the PWM signals is deemed the sinusoidal signal A1 here, but the reference waveform signal need not be sinusoidal, and may have any non-rectangular waveform. For example, a triangular waveform signal or a sawtooth waveform signal may be used. However, the use of a sinusoidal waveform offers the advantages of enabling the loss of voltage when little current is flowing to be reduced, thereby improving power efficiency, as well as of enabling radiation noise to be reduced in tandem with the improvement in power efficiency. As a result, the need for noise mitigation components can be reduced as well. Moreover, while the comparison waveform signal was a sawtooth waveform signal in the fourth embodiment, the comparison waveform signal need not be a sawtooth waveform signal, and may be any signal having a non-rectangular waveform with a shorter wavelength than that of the sinusoidal signal A1. For example, a triangular waveform signal may be used.

E. Variations

The present invention is not limited to the embodiments and aspects described above. The present invention may be worked in various aspects within limits that involve no departure from the spirit of the invention; for example, the following variations are possible.

E-1. Variation 1

The constructions and materials used for the discharge lamp 100 and discharge tube 200 in the above embodiments are mere examples, and other constructions and materials may be used. For example, in the above embodiments, the tip section 222 and the body section 224 of each electrode 220 were shaped so as to form a predetermined angle therebetween, but they need not be shaped in this fashion. For example, they may be formed coaxially such that the tip section 222 and the body section 224 of each electrode 220 form a straight line. Furthermore, in each embodiment, the body sections 224 of the three electrodes 220 were disposed roughly parallel to each other, but they need not be disposed in this fashion, and any positioning of the three electrodes 220 is acceptable so long as they are disposed to one side of a plane that travels through the point of union P. If the body sections 224 of the three electrodes 220 are disposed roughly parallel to each other as in the above embodiments, impediments to the transmission of light along the light transmission path can be further reduced, further preventing light loss.

E-2. Variation 2

In the first embodiment, the electrodes 220 in the discharge tube 200 formed a delta-type construction, but they may alternately form a star-type construction. In this case, a COM (common) electrode is added to the three electrodes shown in FIG. 3 (i.e., the A, B and C electrodes), such that discharge occurs between the A, B, C and COM electrodes.

E-3. Variation 3

In the above embodiments, examples were used in which the discharge tube 200 was driven by a three-phase or two-phase drive circuit, but the discharge tube 200 may be driven by a four-phase drive circuit or any other type of multiple-phase drive circuit. Furthermore, the number of electrodes 220 in the discharge tube 200 may be set to any desired number in accordance with the drive circuit used.

E-4. Variation 4

While light modulation was performed in the above embodiments, it is not required, and it is acceptable if light modulation is not carried out. If light modulation is not performed, the 'maximum output' of the discharge lamp refers to the rated output.

E-5. Variation 5

While voltage control in the above embodiments was performed via PWM control or digital control, the present invention is not limited to these implementations, and voltage control may be carried out using a different type of circuit or the like.

E-6. Variation 6

While the electrodes 1643A-1643C in the above embodiments had non-discharge periods during which discharge did not occur, such periods are not required.

E-7. Variation 7

While the discharge lamp 1600 in the above embodiments included three electrodes 1643A-1643C, four or more electrodes may be used, and the discharge lamp 1600 may be driven by a multiple-phase drive circuit having four or more phases. In this case, when the discharge lamp is to be illuminated at maximum output, it is preferred that power signals be supplied to the discharge lamp such that discharge occurs between at least two electrodes.

E-8. Variation 8

In the above embodiments, the discharge lamp 1600 was a high-voltage mercury lamp using arc discharge. Alternatively, a discharge lamp such as a metal halide lamp or xenon lamp may be used as the discharge lamp 1600.

E-9. Variation 9

Figure 22:
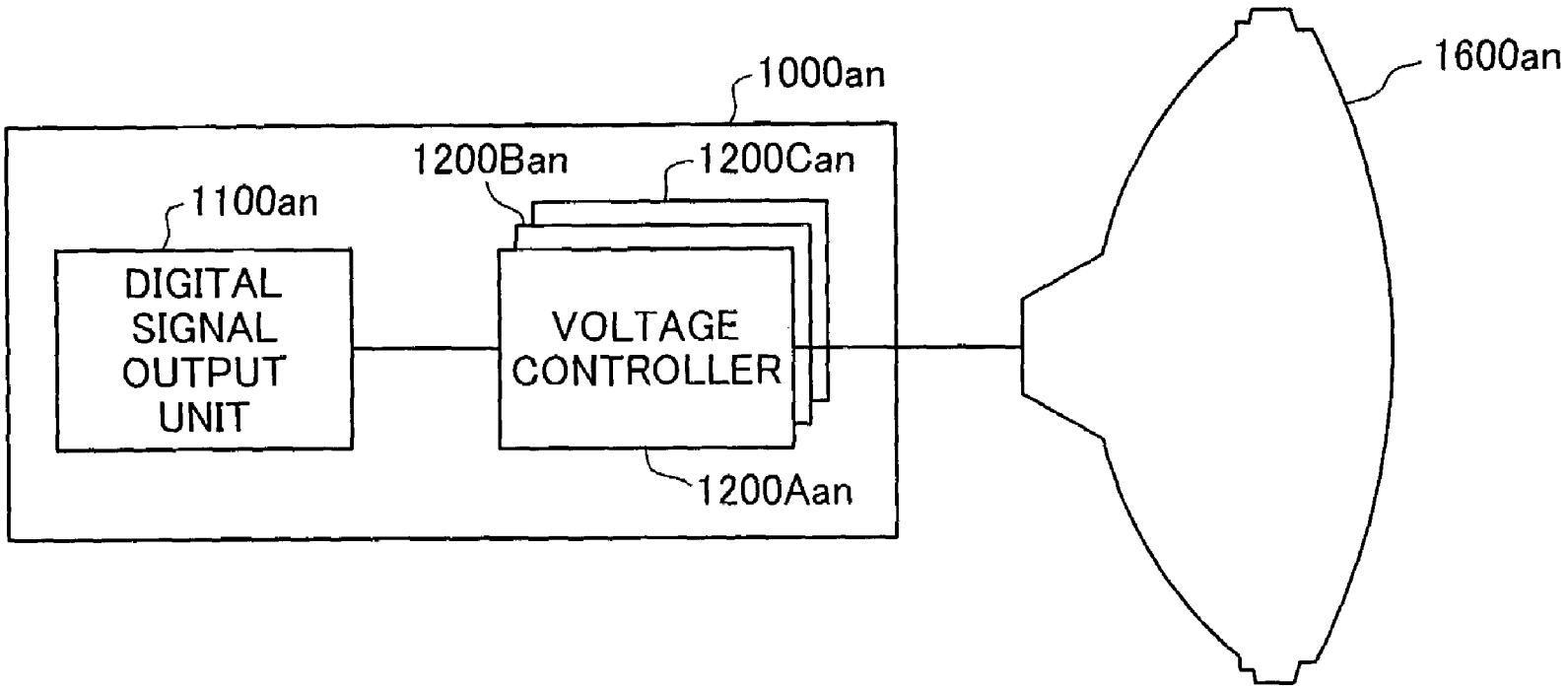
FIG. 22 is an explanatory drawing showing a vehicle illumination device comprising an example of an illumination device.

In the above embodiments, the projection-type image display device was represented by the liquid crystal projector 1010, but the projection-type image display device is not limited to this implementation, and may comprise any general-use liquid crystal display device or a projection-type image display device that uses the DLP™ method. Moreover, the present invention may comprise an illumination device. FIG. 22 is an explanatory drawing showing a vehicle illumination device comprising an example of an illumination device. The vehicle illumination device includes a headlamp 1600*an* as an example of a discharge lamp and a headlamp controller 1000*an*. The headlamp controller 1000*an* includes a digital signal output unit 1100*an* and voltage controllers 1200Aan-1200Can. The digital signal output unit 1100*an* and voltage controllers 1200Aan-1200Can have the respective functions of the digital signal output unit 1100 and voltage controllers 1200A-1200C described in connection with the above embodiments. The vehicle illumination device may further include a light modulation value setting unit having the same function as the above CPU 1700. The illumination device is not limited to use as a vehicle illumination device, and may be employed for various other uses, such as for a cold-cathode tube, a neon tube, or other type of interior or exterior light. According to the illumination device of the present invention, the occurrence of flicker can be prevented without increasing the discharge frequency.

While the discharge lamp control device, discharge lamp control method, projection-type image display device and illumination device pertaining to the present invention were described based on embodiments above, the embodiments of the present invention described above are provided solely in order to aid in understanding the invention, and do not limit the present invention in any way. The present invention may be changed or improved within its essential scope and the accompanying claims, and naturally includes equivalents thereto.

What is claimed is:

1. A discharge tube driven by a multiple-phase drive circuit comprising:

a discharge container including an internal discharge space; and multiple electrodes secured to the discharge container, each of the multiple electrodes corresponding to a phase of the multiple-phase drive circuit, wherein tips of the multiple electrodes protrude inside the discharge space and are oriented toward a predetermined point of union, and all of the multiple electrodes are positioned at one side of a virtual plane including the predetermined point of union.

2. A discharge tube according to claim 1, wherein the multiple electrodes each include a tip section including a tip that protrudes inside the discharge space and a body section that is shaped such that the body section forms a predetermined angle relative to the tip section, and the body sections of the multiple electrodes are disposed substantially parallel to one another.

3. A discharge tube according to claim 1, wherein the multiple-phase drive circuit has three phases, and discharges occur simultaneously within multiple pairs of the electrodes.

4. An apparatus comprising:

a discharge lamp control device configured to control a discharge lamp including three or more electrodes for discharging electricity, wherein the discharge lamp control device supplies to the three or more electrodes power signals having a frequency component, and controls supply of the power signals such that discharge occurs between at least two of the electrodes at all times when the discharge lamp is illuminated at maximum output.

5. An apparatus according to claim 4, wherein the discharge lamp control device controls supply of the power signals such that when the discharge lamp is illuminated at maximum output, non-discharge periods during which a electrode does not be involved in a discharge occur sequentially for each of the three or more electrodes.

6. An apparatus according to claim 4, further comprising:

a digital signal output unit configured to output digital signals such that discharge occurs between at least two of the electrodes at all times when the discharge lamp is illuminated at maximum output; and a power signal generator configured to generate power signals to be supplied to the three or more electrodes based on the digital signals.

7. An apparatus according to claim 6, wherein the digital signal output unit includes:

a waveform generator configured to generate a reference wave signal having a non-rectangular waveform and a comparison wave signal having a non-rectangular waveform that has a shorter wavelength than the reference wave signal; and a first PWM signal generator configured to generate first PWM signals by comparing the reference wave signal and the comparison wave signal, and the digital signal output unit outputs the first PWM signals as the digital signals.

8. An apparatus according to claim 7, wherein the digital signal output unit further includes a second PWM signal generator configured to generate second PWM signals by masking the first PWM signals with a predetermined mask amount such that when the discharge lamp is illuminated at maximum output, non-discharge periods during which a electrode does not be involved in a discharge occur sequentially for each of the three or more electrodes.

9. An apparatus according to claim 8, further comprising a light modulation value setting unit configured to set a light modulation value that regulates intensity of the discharge lamp, wherein the second PWM signal generator adjusts the mask amount in accordance with the light modulation value.

10. An apparatus according to claim 4, wherein the apparatus is an illumination device having the discharge lamp including the three or more electrodes.

11. An apparatus according to claim 4, wherein the apparatus is a projection-type image display device, and the apparatus further comprises:

the discharge lamp including the three or more electrodes; and a projection display unit configured to display via projection an image using illumination light from the discharge lamp.

12. A method of controlling a discharge lamp, the discharge lamp including three or more electrodes for discharging electricity, the method comprising the steps of:

(a) supplying to the three or more electrodes power signals having a frequency component; and (b) controlling supply of the power signals such that discharge occurs between at least two of the electrodes at all times when the discharge lamp is illuminated at maximum output.

* * * * *